US006939654B2

(12) United States Patent
Kotsugai et al.

(10) Patent No.: US 6,939,654 B2
(45) Date of Patent: Sep. 6, 2005

(54) CARRIER AND DEVELOPER FOR DEVELOPING LATENT ELECTROSTATIC IMAGES

(75) Inventors: Akihiro Kotsugai, Shizuoka (JP); Kimitoshi Yamaguchi, Shizuoka (JP); Motoharu Tanaka, Shizuoka (JP); Naoki Imahashi, Shizuoka (JP); Hiroaki Takahashi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/726,669

(22) Filed: Dec. 4, 2003

(65) Prior Publication Data

US 2004/0142269 A1 Jul. 22, 2004

(30) Foreign Application Priority Data

| | | |
|---|---|---|
| Dec. 6, 2002 | (JP) | 2002-354970 |
| Mar. 13, 2003 | (JP) | 2003-068081 |
| Mar. 25, 2003 | (JP) | 2003-082136 |
| Apr. 28, 2003 | (JP) | 2003-123676 |

(51) Int. Cl.[7] ..... G03G 9/113

(52) U.S. Cl. ..... 430/111.35; 430/120; 430/126; 399/119; 399/252

(58) Field of Search ..... 430/111.35, 111.32, 430/111.1, 111.41, 120, 122, 126; 399/111, 119, 252

(56) References Cited

U.S. PATENT DOCUMENTS

| | | | | |
|---|---|---|---|---|
| 4,111,823 | A | 9/1978 | Kobayashi et al. | 252/62.1 P |
| 4,413,297 | A | 11/1983 | Tanaka et al. | 360/119 |
| 4,466,004 | A | 8/1984 | Kobayashi et al. | 346/74.4 |
| 4,544,602 | A | 10/1985 | Kobayashi et al. | 428/336 |
| 4,562,105 | A | 12/1985 | Machida et al. | 428/161 |
| 4,562,136 | A | 12/1985 | Inoue et al. | |
| 4,590,141 | A | 5/1986 | Aoki et al. | |
| 4,617,601 | A | 10/1986 | Tanaka | 360/131 |
| 4,670,322 | A | 6/1987 | Nakamura et al. | 428/172 |
| 4,670,323 | A | 6/1987 | Nakamura et al. | 428/172 |
| 4,670,368 | A | 6/1987 | Tosaka et al. | |
| 4,950,573 | A | 8/1990 | Yamaguchi et al. | |
| 4,990,425 | A | 2/1991 | Nanya et al. | |
| 5,079,123 | A | 1/1992 | Nanya et al. | |
| 5,085,965 | A | 2/1992 | Nanya et al. | |
| 5,102,766 | A | 4/1992 | Nanya et al. | |
| 5,103,422 | A | 4/1992 | Tokita et al. | 365/32 |
| 5,288,577 | A | 2/1994 | Yamaguchi et al. | |
| 5,323,366 | A | 6/1994 | Watada et al. | 369/13 |
| 5,337,293 | A | 8/1994 | Tokita et al. | 369/13 |
| 5,368,972 | A | 11/1994 | Yamashita et al. | 369/13 |
| 5,369,629 | A | 11/1994 | Watada et al. | |
| 5,418,103 | A | 5/1995 | Muto et al. | |
| 5,420,833 | A | 5/1995 | Tanaka et al. | 369/13 |
| 5,429,901 | A | 7/1995 | Muto et al. | |
| 5,430,696 | A | 7/1995 | Tokita et al. | 369/13 |
| 5,459,701 | A | 10/1995 | Tokita et al. | 369/13 |
| 5,487,046 | A | 1/1996 | Watada et al. | 369/13 |
| 5,736,265 | A | 4/1998 | Tanaka et al. | 428/694 ML |
| 5,912,100 | A | 6/1999 | Aoki et al. | |
| 6,004,715 | A | 12/1999 | Suzuki et al. | |
| 6,010,814 | A | 1/2000 | Kotsugai et al. | |
| 6,168,894 | B1 | 1/2001 | Aoki et al. | 430/99 |
| 6,472,118 | B1 | 10/2002 | Yamaguchi et al. | 430/111.35 |
| 6,489,073 | B2 | 12/2002 | Kotsugai et al. | 430/97 |
| 6,500,594 | B2 * | 12/2002 | Hamano et al. | 430/109.4 |
| 6,599,672 | B2 | 7/2003 | Yamaguchi et al. | 430/137.13 |
| 6,653,037 | B2 | 11/2003 | Sawada et al. | 430/106.2 |

FOREIGN PATENT DOCUMENTS

JP 04-188160 A * 7/1992

OTHER PUBLICATIONS

USPTO English–language translation of JP 04–188160 (pub. Jul. 1992).*

Derwent abstract Acc. No. 1992–274219, describing JP 04–188160, pub. Jul. 1992.*

Grant, R., et. a., ed., *Grant & Hackh's Chemical Dictionary*, 5th edition, McGraw–Hill Book Co., NY (1987), p. 531.*

Neufeldt, V., et. al., ed., *Webster's New World Dictionary*, third college edition, Simon & Schuster, Inc., NY (1988), p. 464.*

* cited by examiner

*Primary Examiner*—Janis L. Dote

(74) *Attorney, Agent, or Firm*—Oblon, Spivak, McClelland, Maier & Neustadt, P.C.

(57) ABSTRACT

A carrier develops latent electrostatic images in corporation with a toner and one particle of the carrier includes a magnetic particle, and a coating layer covering the magnetic particle. The coating layer includes a crosslinked condensation product of a composition containing (i) an N-alkoxyalkylated polyamide and (ii) at least one resin that is reactive with the alkoxyalkylated polyamide and includes a silicone having a silanol group and/or a hydrolyzable group.

29 Claims, 1 Drawing Sheet

FIGURE
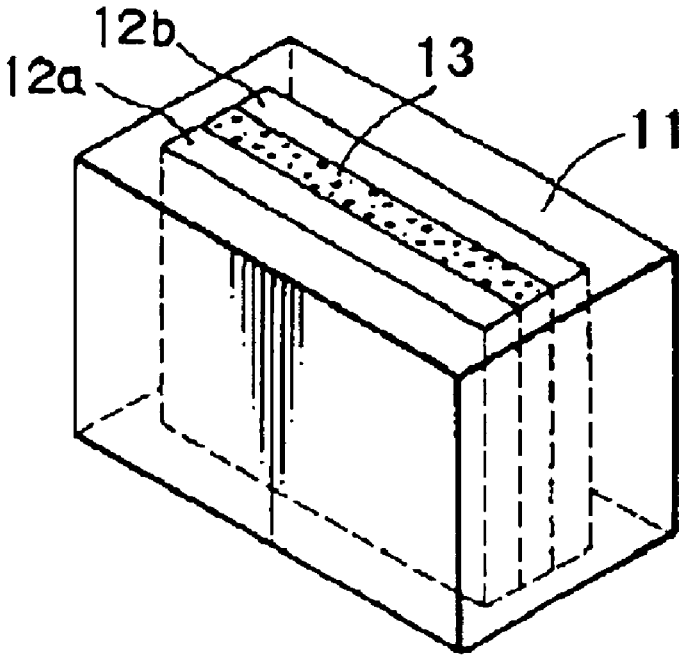

CARRIER AND DEVELOPER FOR DEVELOPING LATENT ELECTROSTATIC IMAGES

FIELD OF THE INVENTION

The present invention relates to a carrier for developing latent electrostatic images for use in a two-component developer in electrophotography and/or electrostatic recording, a developer for latent electrostatic images using the carrier, and a process cartridge using the developer.

DESCRIPTION OF THE RELATED ART

Electrophotographic color printers have been increasingly used, and the printing speed of these printers becomes higher and higher.

Two-component developing methods are suitable for high-speed printing, can employ a non-magnetic toner having good handleability and are widely used in full-color image forming apparatus. However, such full-color image forming apparatus must each have plural developing devices therein and are thereby have larger sizes and heavier weights than monochrome image forming apparatus. In particular, two-component developing devices must have an extra capacity and a stirring mechanism for a developer in addition to a toner as compared with one-component developing devices. To miniaturize the developing devices, the amount of the developer must be reduced.

A carrier in a developer undergoes mechanical friction and impact over and over again from a toner and members including sliding members and controlling members such as sleeves and blades or agitating and conveying members such as screws and paddles in a developing device. A reduced amount of the developer induces an increasing possibility of friction between the toner and carrier per one printing procedure and an increasing frequency of the carrier to pass through the developing unit. As a result, the carrier in the developing unit rapidly wears.

With an increasing printing speed, durability of the carrier, especialy a high wear resistance of a coating layer on a surface of the carrier becomes more and more important. In addition, the carrier must maintain rapid charging ability for a long time while avoiding spent (stain) of the carrier surface by the toner and other members.

Recent digital copiers and printers often negatively develop images using a negatively charged photoconductor and a negatively charged toner. To charge a toner negatively, techniques for incorporating a nitrogen-containing organic compound into a coating film of the carrier have been widely proposed.

In the carrier coating film, for example, a silicone resin and an aminosilane coupling agent are used, a specific acid amide is internally added, an amino compound such as melamine or guanamine or a derivative thereof is internally added, or an acrylic copolymer having amino groups is used.

For example, Japanese Patent Application Laid-Open (JP-A) No. 49-115549 discloses a polyamide as a nitrogen-containing organic material for use in a coating material.

However, most of nylons and other polyamide resins have low solubility in solvents, cannot be significantly formed into a film by an easy procedure such as coating of a solution and have insufficient wear resistance, although they are suitable for charging a toner negatively.

As a possible solution to these problems, a solubilized polyamide treated to be soluble in a solvent is used. For example, JP-A Nos. 49-115549, 01-118150, 01-118151, 04-188160 and 2001-201894, and Japanese Patent (JP-B) No. 3044390 each disclose a technique of using a polyamide except with an alkoxy group or alkoxyalkyl group replacing the hydrogen atom of its amide bond. JP-B Nos. 2835971 and 2835972 each disclose the use of a graft polymer having such an alkoxylated or alkoxyalkylated polyamide in its principal chain. However, a coating layer mainly comprising this type of polyamides is still insufficient in wear resistance.

JP-B No. 02932192 discloses a coating layer of a carrier comprising a N-methoxymethylated polyamide and having a surface resistivity of 13 Ω·cm or less, indicating that partial methoxymethylation of a polyamide may reduce the resistance of the coating layer. However, the reduced resistance of the carrier according to this technique is derived from high hydrophilicity of residual methoxy groups, which invites a varied charge amount depending on the environment and/or a largely reduced charge amount of the resulting developer during storage.

ADVANTAGES AND OBJECTS

An object of the present invention is to solve the above problems.

Specifically, an object of the present invention is to provide a carrier for developing latent electrostatic images, which is capable of stably charging over a long period of time, has a coating layer with high wear resistance and can inhibit variation in charge due to spent by a toner composition. Another object of the present invention is to provide a carrier that can inhibit variation in charging ability depending on the environment and decreased charge amount during storage and can avoid problems such as variation in image density, toner deposition on the background of images, and toner particle scattering in image forming apparatus. Still another object of the present invention is to provide a coated carrier which contains magnetic particles and a coating layer satisfactorily adhered with the magnetic particles and can be prepared in a high yield. Yet another object of the present invention is to provide a developer for latent electrostatic images using the carrier, and a process cartridge using the developer.

SUMMARY OF THE INVENTION

Above and other objects can be achieved by the present invention.

Specifically, the present invention provides, in a first aspect, a carrier for developing latent electrostatic images, including a magnetic particle, and a coating layer covering the magnetic particle, wherein the coating layer contains a condensation product of a composition containing (i) an alkoxyalkylated polyamide, and (ii) a silicone resin that is reactive with the alkoxyalkylated polyamide.

Thus, the resulting carrier has excellent positive charging ability by virtue of the polyamide, has a coating layer with high strength and is resistant to spent by virtue of the silicone resin.

The silicone resin that is reactive with the alkoxyalkylated polyamide is preferably a resin containing a silicone at least having a silanol group and/or a hydrolyzable group. The silicone more preferably contains at least a silanol group.

The coating layer preferably shows a wear rate of 50% or less as determined immediately after continuously reproducing 100,000 copies of a character image with an image areal ratio of 12% using a developer comprising 93 parts by weight of the carrier and 7 parts by weight of a toner with a copying machine. The wear rate may be determined by using IPSIO Color 8000 as the copying machine, and IPSIO Color 8000 Black Toner as the toner. Specifically, the sample developer for this wear test was prepared in a manner that 260.4 g of carrier, 19.6 g of the above toner were placed in a hollow stainless steel container, and were stirred for 1 minute using TURBULLA Mixer (TURBULLA Type T2F, Willy A. Bechofen AG Machinenfabrik). The resulted developer was loaded in the developing unit of IPSIO Color 8000, and printing of character-image in A4 size was continuously performed with the toner density of 7% by weight. Here, the imaging area was 12% relative to A4 size. After completion of printing, the developer was removed from the developing unit and added into the ionizing water containing a small amount of nonionic surfactant. This solution was washed repeatedly by stirring and removing of supernatant so as to separate the carrier from the solution. The separated carrier was subjected to measure the thickness of the coating layer.

The composition preferably further includes (iii) a silicone compound having at least one of a hydrolyzable group and a group capable of crosslinking upon polycondensation. Thus, carrier particles become resistant to aggregation during coating, and satisfactorily coated carrier particles can be produced in high yields.

The silicone compound (iii) is preferably at least one of an aminosilane coupling agent, and a monofunctional or bifunctional silane compound having at least one of a terminal group represented by formula: $C_nH_{2n+1}$—, wherein "n" is an integer of 1 to 4, and a terminal phenyl group. Thus, carrier particles become more resistant to aggregation during coating, and satisfactorily coated carrier particles can be produced in higher product yields.

The monofunctional or bifunctional silane compound preferably has at least one of a hydroxyl group, a methoxy group and an ethoxy group.

The aminosilane coupling agent preferably has an amino equivalent of 170 to 230.

The alkoxyalkylated polyamide is preferably at least one N-alkoxyalkylated polyamide having a repeating unit represented by following Formula I:

Formula I

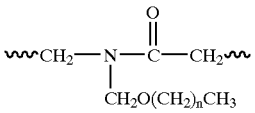

wherein "n" is an integer of 0 to 5.

In Formula I, the repetition number "n" is preferably an integer from 1 to 5 for avoiding aggregation of carrier particles and for better yields. If a large proportion of a lower alcohol is used as a solvent in coating of a carrier using a polyamide soluble in an alcohol, the polyamide dissolved in the lower alcohol precipitates at a lower temperature than a silicone resin, thus inviting phase separation between the two resins. The polyamide inherently has adherence, and carrier particles aggregate with one another upon phase separation to thereby decrease the yields.

However, the use of the N-alkoxyalkylated polyamide of Formula I, wherein "n" is an integer from 1 to 5, enables the use of a higher alcohol as the solvent. Thus, the polyamide is prevented from precipitating at low temperatures and the aggregation of carrier particles can be inhibited to thereby increase the yields.

The solubility of the polyamide in a higher alcohol increases with an increasing number "n" in Formula I, but am N-alkoxyalkylated polyamide of Formula I, wherein "n" is an integer of 6 or more, may result in excessively soft coating layer to deteriorate wear resistance of the carrier. The repetition number "n" is therefore preferably an integer from 1 to 5.

More preferably, the repetition number "n" is 3. Namely, the alkoxyalkylated polyamide is specifically preferably N-butoxymethylated polyamide, wherein "n" in Formula I is 3, for markedly increased yields.

The alkoxyalkylated polyamide is preferably an N-alkoxyalkylated polyamide having an alkoxylation ratio of 20% by mole to 70% by mole.

The condensation product is preferably a product of a condensation reaction between the alkoxyalkylated polyamide and the silicone resin, and a self-condensation reaction of the silicone resin.

The carrier preferably has a positively chargeable site that can be positively charged when the carrier is mixed with a toner. The positively chargeable site is preferably an amide bonding site in the condensation product.

The composition for the coating layer preferably further contains an organic solid acid having a boiling point of 100° C. or higher as a catalyst. By using such an acid catalyst that can work at a crosslinking temperature of the coating layer, a crosslinking reaction proceeds sufficiently.

The composition may further contain a methylol melamine. The resulting coating layer can have improved charging ability and higher strength.

The composition may further contain a methylol benzoguanamine.

The composition preferably further contains a phenolic resin. By allowing the polyamide to have crosslinks partially, the coating layer can have further excellent wear resistance.

The carrier preferably has an electric resistivity in terms of log R of 14 or more at an applied electric field of 50 V/mm and an electric resistivity in terms of log R of 16 or less at an applied electric field of 250 V/mm. Thus, the variation in charging ability depending on the environment and the decreased charge amount of the developer after left stand can be prevented.

The coating layer may include a low-resistance substance having an electric resistivity of $10^{-4}$ to $10^{8}$ Ω·cm, such as electrically conductive carbon. Thus, the carrier can have a desired electric resistance.

The coating layer may include hard fine particles. Thus, the coating layer is reinforced and thereby has high durability.

It is preferred that the carrier has a weight-average particle diameter Dw in a range of 25 to 45 μm, that the carrier comprises component particles having a diameter of less than 44 μm in an amount of 70% by weight or more, and component particles having a diameter of less than 22 μm in an amount of 7% by weight or less, based on the total amount of the carrier, and that the ratio Dw/Dp of the weight-average particle diameter Dw and a number-average particle diameter Dp of the carrier is in a range of 1.00 to 1.30.

The present invention also provides, in a second aspect, a developer for latent electrostatic images containing the carrier for developing latent electrostatic images according to the first aspect, and a toner for developing latent electrostatic images.

The present invention further provides, in a third aspect, a process cartridge including a development unit for developing a latent electrostatic image formed on a surface of a latent electrostatic image bearing member; and at least one of a latent electrostatic image bearing member, a charging unit for uniformly charging the latent electrostatic image bearing member, and a blade for wiping off a developer remained on a surface of the latent electrostatic image bearing member, the process cartridge being integrated with and detachable with an image forming apparatus, wherein the developing unit contains the developer for latent electrostatic image of the present invention.

In a fourth aspect, the present invention provides an image forming apparatus including a latent electrostatic image bearing member; a charging unit for uniformly charging the latent electrostatic image bearing member; an exposing unit for applying the latent electrostatic image bearing member with light imagewise to form a latent image; a development unit containing a developer and working to develop the latent image using the developer to form a toner image; and a transferring unit for transferring the toner image from the latent electrostatic image bearing member to a recording medium, wherein the developer is the developer for latent electrostatic images of the present invention.

In a fifth aspect, the present invention provides an image forming process including the steps of charging a latent electrostatic image bearing member; exposing the charged latent electrostatic image bearing member to light imagewise to form a latent electrostatic image; developing the latent electrostatic image by supplying a developer thereto to thereby form a visible toner image; and transferring the formed toner image to a transfer member, wherein the developer is the developer for latent electrostatic images of the present invention.

BRIEF DESCRIPTION OF THE DRAWING

FIGURE is a perspective view of an apparatus for use in measuring the resistivity of a carrier in production examples.

DESCRIPTION OF THE PREFERRED EMBODIMENTS

The carrier for developing latent electrostatic images (hereinafter may be simply referred to as "carrier") of the present invention comprises magnetic particles, and each of the magnetic particles is covered with a coating layer. The coating layer comprises a condensation product of a composition comprising an alkoxyalkylated polyamide and a silicone resin that is reactive with the alkoxyalkylated polyamide.

A polyamide for use in the present invention should be a solvent-solubilized polyamide derived from a polyamide except with an alkoxyalkyl group replacing the hydrogen atom of an amide bond in its principal chain. The carrier may be prepared in the following manner. Initially, a coating liquid is prepared by mixing and dissolving an alcohol solution of the alkoxyalkylated polyamide, one or more silicone resins that are reactive with the alkoxyalkylated polyamide, and, where necessary, a catalyst for accelerating crosslinking. The coating liquid is applied to a magnetic carrier core material, dried, heated and cured to form a coating layer. The term "polyamide" used herein means and includes, for example, regular polyamides prepared from a dicarboxylic acid and a diamine and polyamides prepared by ring-opening and polycondensation of a lactam.

Of the alkoxyalkylated polyamides, alkoxymethylated polyamides may be prepared, for example, by allowing a polyamide to react with formaldehyde in the presence of a higher alcohol in an acidic atmosphere that can dissolve the polyamide therein, such as formic acid.

Alternatively, alkoxymethylated polyamides can be prepared in the following manner. A polyamide is allowed to react with formaldehyde in the presence of methanol to form a methoxymethylated polyamide. The methoxymethylated polyamide is subjected to transetherification using, for example, ethyl alcohol, n-propyl alcohol, isopropyl alcohol, butyl alcohol, amyl alcohol (pentyl alcohol) or hexyl alcohol, to replace the methoxy group with, for example, ethoxy, propoxy, butoxy, pentyloxy or hexyloxy group.

The formed alkoxymethylated polyamides in the above-described manner have improved solubility in a lower alcohol such as methanol according to its reaction ratio, thus facilitating the formation of a coating layer on surfaces of carrier core particles.

The alkoxyalkylated polyaxnide is preferably at least one N-alkoxyalkylated polyamide having a repeating unit represented by following Formula I:

Formula I

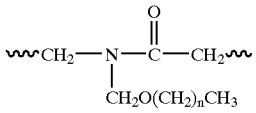

wherein "n" is an integer of 0 to 5. The repetition number "n" is preferably an integer of 1 to 5.

The N-alkoxyalkylated polyamide having the repeating unit of Formula I, where "n" is an integer of 1 to 5, has improved solubility in a higher alcohol according to its reaction ratio. Thus, a carrier comprising the N-alkoxyalkylated polyamide in its coating layer can be prepared by using a higher alcohol in a high yield. The resulting carrier does not invite phase separation between the polyamide and the silicone resin and shows less aggregation among carrier particles.

The polyamide exhibits rubber elasticity before crosslinking (curing) and is cured and hardened by heating in the presence of a suitable acid catalyst to thereby condensation product between its alkoxy group and an active hydrogen in the amide bond of its principal chain. The crosslinked polyamide is mixed with a silanol-condensable silicone resin; the composition is coated as a carrier coating layer, is heated in the presence of an acid catalyst and thereby forms a coating layer with crosslinks between the silicone resin and the polyamide.

Examples of polyamides for use in the present invention include polycondensation products of a diamine component and a carboxylic acid component. Examples of the diamine component are 1,6-hexanediamine, 1,8-octanediamine, 1,2-propanediamine, and other linear or branched-chain alkyl diamines; m-phenylenediamine, p-phenylenediamine, o-phenylenediamine, toluene-2,5-diamine, N-phenyl-p-phenyldiamine, 4,4-diaminodiphenylamine, and other aromatic diamines. Examples of the carboxylic acid component are maleic acid, fumaric acid, mesaconic acid, citraconic acid, terephthalic acid, isophthalic acid, cyclohexanedicarboxylic acid, succinic acid, adipic acid, sebacic acid, dodecanoic acid, malonic acid, and other aliphatic or aromatic di- or higher carboxylic acids. Examples of the polyamides also include polycondensation products of amino acids, copolymers comprising plural types of these monomers, ring-opened polycondensation products of caprolactam and other lactams, self-polycondensation products of aminoundecanoic acid and other amino acids, and copolymers of plural types of these monomer components.

The ratio of alkoxyalkylation for solubilizing the polyamide is preferably from about 20% by mole to about 70% by mole in terms of a substitution ratio of active hydrogens in amide bonds. If the alkoxyalkylation ratio is less than about 20% by mole, the resulting polyamide may be dissolved in alcohol insufficiently to thereby precipitate during, or may segregate after, the formation of the coating layer. If it exceeds about 70% by mole, the coating layer may have an excessively low density to thereby deteriorate its wear resistance. This is also true when the coating layer further comprises particles of metal oxide.

The weight ratio of the alkoxyalkylated polyamide (i) to the silicone resin (ii) that is reactive with the alkoxyalkylated polyamide is preferably from about 10:90 to about 30:70. The silicone resin (ii) is preferably a resin containing a silicone resin having at least one of a silanol group and a hydrolyzable group and being reactive with the alkoxyalkylated polyamide.

The composition for the carrier may further comprise a silicone compound having at least one of a hydrolyzable group and a group capable of crosslinking upon polycondensation.

Examples of the silicone compound are aminosilane coupling agents, and monofunctional or bifunctional silane compounds each having at least one of a terminal group represented by formula: $C_nH_{2n+1}$—, wherein "n" is an integer of 1 to 4, and a terminal phenyl group.

In the monofunctional or bifunctional silane compounds just mentioned above, a Si atom is combined through a Si—C bond with an organic group, i.e., the group having one of a terminal group represented by formula: $C_nH_{2n+1}$—, wherein "n" is an integer of 1 to 4, and a terminal phenyl group. The Si atom is further combined with one or two of hydrolyzable groups and/or groups capable of crosslinking upon polycondensation. The groups capable of crosslinking upon polycondensation are preferably hydroxyl group, methoxy group and/or ethoxy group.

Typical examples of the monofunctional or bifunctional silane compound having one of a terminal group represented by formula: $C_nH_{2n+1}$—, wherein "n" is an integer of 1 to 4 and a terminal phenyl group for use in the present invention are:

$(CH_3)_3SiOCH_3$,
$(CH_3)_3SiOC_2H_5$,
$(CH_3)_2Si(OCH_3)_2$,
$(C_2H_5)_2Si(OC_2H_5)_2$,
$(CH_3)(C_2H_5)Si(OCH_3)_2$,
$(C_6H_5)_2Si(OCH_3)_2$,
$(C_6H_5)_2Si(OC_2H_5)_2$,
$(CH_3)_3SiOH$, and
$(C_2H_5)_3SiOH$.

The content of the monofunctional or bifunctional silane compound is preferably from 0.1% by weight to 20% by weight, and more preferably from 0.5% by weight to 10% by weight of resins constituting the outermost layer (coating layer). If the content is less than 0.1% by weight, the charging ability may become susceptible to the environment and the yields of product carriers may be decreased. If it is more than 20% by weight, the coating resin may become fragile and the coating layer may have insufficient wear resistance.

The aminosilane coupling agents are silane coupling agents each having at least one of primary, secondary or tertiary amino group. The amino equivalent of the aminosilane coupling agent is preferably from 170 to 230. The term "amino equivalent" used herein means a value obtained by dividing the molecular weight of the aminosilane coupling agent by the number of nitrogen elements in the aminosilane coupling agent. The use of an aminosilane coupling agent having an amino equivalent of 170 or more may further inhibit a decreased charge amount due to running. If the amino equivalent is excessively high, the amount of the aminosilane coupling agent must be increased for equivalent yields of products as in the case of an aminosilane coupling agent having a low amino equivalent. Accordingly, the amino equivalent is preferably 230 or less. The aminosilane coupling agent therefore preferably has an amino equivalent of 170 to 230.

Typical examples of the aminosilane coupling agent are as follows.

TABLE 1

| | MW | Amino equivalent |
|---|---|---|
| $H_2N(CH_2)_3Si(OCH_3)_3$ | 179.3 | 179.3 |
| $H_2N(CH_2)_3Si(OC_2H_5)_3$ | 221.4 | 221.4 |
| $H_2NCH_2CH_2CH_2Si(CH_3)_2(OC_2H_5)$ | 161.3 | 161.3 |
| $H_2NCH_2CH_2CH_2Si(CH_3)(OC_2H_5)_2$ | 191.3 | 191.3 |
| $H_2NCH_2CH_2NHCH_2Si(OCH_3)_3$ | 194.3 | 97.2 |
| $H_2NCH_2CH_2NHCH_2CH_2CH_2Si(CH_3)(OCH_3)_2$ | 206.4 | 103.2 |
| $H_2NCH_2CH_2NHCH_2CH_2CH_2Si(OCH_3)_3$ | 224.4 | 111.2 |
| $(CH_3)_2NCH_2CH_2CH_2Si(CH_3)(OC_2H_5)_2$ | 219.4 | 219.4 |
| $(C_4H_9)_2NC_3H_6Si(OCH_3)_3$ | 291.6 | 291.6 |

The content of the aminosilane coupling agent is preferably from 0.1% by weight to 20% by weight, and more preferably from 0.5% by weight to 10% by weight of resins constituting the coating layer. If the content is less than 0.1% by weight, the charging ability may become susceptible to the environment. If it exceeds 20% by weight, the coating layer may have decreased adhesion with the surfaces of fine particles.

For sufficiently curing the coating layer, the coating layer is preferably heated under acidic conditions. More preferably, a coating liquid for the coating layer comprises an organic solid acid having a boiling point of 100° C. or higher as an acid catalyst. A catalyst having a boiling point of lower than 100° C. may be vaporized when the coating layer is dried and the coating layer may not be sufficiently cured even by secondary heating for crosslinking. Among such organic solid acids, dibasic or higher polycarboxylic compounds are preferred.

Examples of the acid catalyst are lactic acid, lauric acid, crotonic acid, succinic acid, glutaric acid, adipic acid, pimelic acid, azelaic acid, sebacic acid, oxalic acid, glycolic acid, malonic acid, maleic acid, itaconic acid, tartaric acid, benzoic acid, phthalic acid, trimellitic acid, benzenesulfonic acid, toluenesulfonic acid, and other organic acids; hydrochloric acid, sulfuric acid, nitric acid, hypophosphorous acid, and other inorganic acids. Each of these acids can be used alone or in combination. For smoothly and properly proceeding the crosslinking reaction, at least one acid catalyst having a boiling point of 100° C. or higher may be used.

The resin that is reactive with the alkoxyalkylated polyamide for use in the present invention means a resin having an alcohol, alkylol or carboxylic acid moiety that can undergo condensation with an alkoxy group in the polyamide, or one having an amino group with an active hydrogen. Typical examples of such resins are thermosetting resins, of which silicone resins are preferred. By using a silicone resin, the coating layer can have a satisfactory strength and a low surface energy, thus inhibiting "spent" in which toner particles adhere the carrier.

The silicone resin for use in the present invention preferably has at least one of a silanol group and a hydrolyzable group. The term "hydrolyzable group" used herein means and includes a group that can yield a silanol group as a result of hydrolysis, such as methoxy group, ethoxy group, and isopropoxy group.

Upon heating, the silanol group is crosslinked with the alkoxy group of the polyamide and is esterified with the organic acid used as the catalyst for the polyamide to form an ester. Thus, negative charging due to residual acid catalyst can be inhibited. The coating layer may further comprise one or more crosslinkable resins for controlling the charge amount of the coating layer and for increasing the strength thereof. Among them, hexamethylol melamine, tetramethylol benzoguanamine, and other alkylol melamines, alkyl ethers and other derivatives thereof are preferred for providing high strength and high charge amount of the coating layer concurrently.

The coating layer preferably further comprises a small amount of a phenolic resin for higher strength. The content of the phenolic resin is preferably from 2% by weight to 10% by weight, and more preferably from 4% by weight to 8% by weight of the resins constituting the outermost layer (coating layer). If the content is less than 2% by weight, the strength of the coating layer may not be sufficiently improved. If it exceeds 10% by weight, the carrier may have decreased charging ability with time.

The alkoxyalkylated polyamide for use in the present invention has a low electric resistance before crosslinking and may invite toner deposition on the background of images, decreased charge amount of the developer during storage, and/or variation in charge amount depending on temperature and humidity. Accordingly, residual free alkoxy moieties must be sufficiently crosslinked in a heating process for forming crosslinks with the silicone resin. The heating temperature is preferably from 150° C. to 300° C. If the heating temperature is lower than 150° C., the alkoxyalkylated polyamide may not be sufficiently crosslinked with the silicone resin. If it higher than 300° C., the components of the alkoxyalkylated polyamide may be carbonized, and the entire coating layer may have a decreased electric resistance and a decreased strength, thus inviting a reduced wear resistance.

The carrier preferably has an electric resistivity in terms of log R of 14 to 17 at an applied electric field of 50 V/mm and log R of 8 to 16 at an applied electric field of 250 V/mm. If the log R is less than 14 at an applied electric field of 50 V/mm, the charge amount may decrease markedly during storage and may significantly vary depending on temperature and humidity. If the log R is more than 16 at an applied electric field of 250 V/mm, the carrier may be charged up during continuous printing, thus inviting decreased image densities.

To control the electric resistivity of the carrier appropriately, the coating layer may further comprise an electrically conductive substance. The electrically conductive substance for use herein can be any of known electrically conductive materials, such as powders of metals such as electrically conductive ZnO or Al; $SnO_2$ prepared by various processes, and $SnO_2$ doped with various elements; borides such as $TlB_2$, $ZnB_2$, and $MoB_2$; silicon carbide; electrically conductive polymers such as polyacetylenes, poly(p-phenylene)s, poly(p-phenylene sulfide)s, and polypyrroles; and electrically conductive carbon black. Among them, electrically conductive carbon black is preferred for controlling the electric resistance within a wide range.

For reinforcing, the coating layer may further comprise additional hard fine particles. Among them, fine particles of metal oxides and other inorganic oxides have uniform particle diameters, have high affinity for the polyamide in the coating layer, can markedly reinforce the coating layer and are thereby preferred.

Examples of such particles are conventional particles such as particles of silica, titanium oxide, and alumina. Each of these can be used alone or in combination.

The content of the hard fine particles in the coating layer is preferably from 5% by weight to 70% by weight, and more preferably from 20% by weight to 40% by weight based on the weight of the coating layer. A suitable content of the hard fine particles may vary depending on the average particle diameter and specific surface area of the fine particles. If the content is less than 5% by weight, the coating layer may not sufficiently exhibit its wear resistance. If it is more than 70% by weight, the fine particles may tend to flake off.

The metal oxide particles may be incorporated into the coating layer, for example, in the following manner.

Initially, the solubilized polyamide is dissolved in an alcohol, where necessary, with heating. If desired, a mixture of a lower alcohol and a higher alcohol can be used.

Next, the metal oxide particles are mixed with and homogeneously dispersed in the solution by using a disperser such as a homogenizer.

The resulting dispersion is mixed with a non-aqueous solution of a silanol-condensable silicone prepared separately, is dispersed in a homogenizer, and is mixed with appropriate additives such as a charge control agent and a resistance control agent to yield a coating liquid. The coating liquid is then applied to the carrier core material.

Examples of the carrier core material for use in the present invention are conventional materials such as particles having a weight-average particle diameter of about 10 $\mu$m to 100 $\mu$m made of, for example, iron, cobalt, and other ferromagnetic substances, as well as magnetite, hematite, Li ferrite, Mn—Zn ferrite, Cu—Zn ferrite, Ni—Zn ferrite, and Ba ferrite.

The coating layer can be applied to the carrier core material according to a conventional procedure such as spray drying, impregnation, and powder coating.

The developer of the present invention essentially comprises the aforementioned carrier and a toner.

The toner for use in the developer mainly comprises a thermoplastic resin as a binder resin and further comprises a coloring agent, fine particles, a charge control agent, a releasing agent, and other components according to necessity. The toner can be prepared according to a conventional production procedure such as pulverization and polymerization.

Examples of the binder resin are polystyrenes, polyvinyltoluenes, and other homopolymers of styrene and its substituted derivatives; styrene-p-chlorostyrene copolymers, styrene-propylene copolymers, styrene-vinyltoluene copolymers, styrene-methyl acrylate copolymers, styrene-ethyl acrylate copolymers, styrene-butyl acrylate copolymers, styrene-methyl methacrylate copolymers, styrene-ethyl methacrylate copolymers, styrene-butyl methacrylate copolymers, styrene-methyl o-chloroacrylate copolymers, styrene-acrylonitrile copolymers, styrene-vinyl methyl ether copolymers, styrene-vinyl methyl ketone copolymers, styrene-butadiene copolymers, styrene-isobutylene copolymers, styrene-maleic acid copolymers, styrene-maleate copolymers, and other styrenic copolymers; poly(methyl methacrylate)s, poly (butyl methacrylate)s, poly(vinyl chloride)s, poly(vinyl acetate)s, polyethylenes, polypropylenes, polyesters, polyurethanes, epoxy resins, poly(vinyl butyral)s, poly (acrylic acid)s, rosin, modified rosin, terpene resins, phenolic resins, aliphatic or aromatic hydrocarbon resins, aromatic petroleum resins, chlorinated paraffin, and paraffin wax. Each of these resins can be used alone or in combination.

Polyesters may be prepared by polycondensation between an alcohol component and a carboxylic acid component.

Examples of the alcohol component are polyethylene glycol, diethylene glycol, triethylene glycol, 1,2-propylene glycol, 1,3-propylene glycol, 1,4-propylene glycol, neopentyl glycol, 1,4-butenediol, and other diols; 1,4-bis (hydroxymethyl)cyclohexane, bisphenol A, hydrogenated bisphenol A, polyoxyethylenated bisphenol A, polyoxypropylenated bisphenol A, other etherized bisphenols; dihydric alcohol monomers derived from these compounds except with a substituted saturated or unsaturated hydrocarbon group having 3 to 22 carbon atoms, and other dihydric alcohol monomers; sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and other trihydric or higher alcohol monomers.

Examples of the carboxylic acid component for the preparation of the polyesters are palmitic acid, stearic acid, oleic acid, and other monocarboxylic acids; maleic acid, fumaric acid, mesaconic acid, citraconic acid, terephthalic acid, cyclohexanedicarboxylic acid, succinic acid, adipic acid, sebacic acid, malonic acid, divalent organic acid monomers derived from these acids except with a substituted saturated or unsaturated hydrocarbon group having 3 to 22 carbon atoms, anhydrides of these acids, dimers of a lower alkyl ester and linoleic acid, and other dicarboxylic acid monomers; 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxylic acid-2-methyl-2-methylenecarboxypropane, tetra(methylenecarboxyl) methane, 1,2,7,8-octanetetracarboxylic acid, Enbol trimer acid, anhydrides of these acids, and other trivalent or higher polycarboxylic acid monomers.

Examples of the epoxy resins are polycondensation products between bisphenol A and epichlorohydrin, a part of which are commercially available under the trade names of Epomik R362, R364, R365, R366, R367 and R369 from Mitsui Chemicals Inc., EpoTohto YD-011, YD-014, YD-904, YD-017 from Tohto Kasei Co., Ltd., EPOCOAT 1002, 1004, 1007 from Shell Chemicals Japan Ltd.

Examples of the coloring agent include, but are not limited to, carbon black, lamp black, iron black, ultramarine blue, nigrosine dyes, aniline blue, phthalocyanine blue, Hansa yellow G, Rhodamine 6G lake, chalco-oil blue, chrome yellow, quinacridone, benzidine yellow, rose bengal, triarylmethane dyes, mono-azo or di-azo pigments and other known dyes and pigments. Each of these can be used alone or in combination.

The toner may further comprise a charge control agent (polarity control agent) for controlling charging ability by friction as in conventional toners. Examples of the charge control agent (polarity control agent) include, but are not limited to, metal complex salts of monoazo dyes, nitrofumic acid and salts thereof, complexes of metals such as Co, Cr, Fe, or Zn with salicylic acid, naphthoic acid or a dicarboxylic acid. Each of these can be used alone or in combination. Such polarity control agents for use in color toners must be colorless. Polymeric polarity controlling substances having polarity are preferred.

The toner may further comprise a fluidity improver. Examples of the fluidity improver for use in the present invention are fine particles of organic resins, metal soaps, polytetrafluoroethylene and other fluorocarbon resins, zinc stearate, and other lubricants; cerium oxide, silicon carbide, and other abrasives; metal oxides generally used for improving fluidity, such as particles of metal oxides including silicon oxide, titanium oxide, aluminum oxide, and derived from these metal oxides except with hydrophobed surfaces. Each of these particles is preferably treated to be hydrophobic for better improvement of the fluidity. They can be treated to be hydrophobic, for example, by bringing a silicon compound generally known as a silane coupling agent or silanizing agent into contact with the surface of the particles.

Such hydrophobing agents include, but are not limited to, chlorosilanes such as trichlorosilane, methyldichlorosilane, dimethyldichlorosilane, trimethylchlorosilane, ethyldichlorosilane, diethylchlorosilane, triethylchlorosilane, propyldichlorosilane, dipropyldichlorosilane, tripropylchlorosilane, and other alkylchlorosilanes, phenylchlorosilane, fluorine-substituted derivatives thereof, such as fluoroalkylchlorosilanes and perfluoroalkylchlorosilanes; silylamines such as hexamethyldisilazane and diethylaminotrimethylsilane; silylamides such as N,O-bistrimethylsilylacetamide, N-trimethylsilylacetamide, and bistrimethylsilyltrifluoroacetamide; alkoxysilanes such as methyltrialkoxysilanes, dimethyldialkoxysilanes, trimethylalkoxysilanes, ethyldialkoxysilanes, diethylalkoxysilanes, triethylalkoxysilanes, propyltrialkoxysilanes, dipropyldialkoxysilanes, tripropylakoxysilanes, alkylchlorosilanes, phenylalkoxysilanes each having a phenyl group, fluorine-substituted derivatives thereof such as fluoroalkylalkoxysilanes, and perfluoroalkylalkoxysilanes; silicone oils such as dimethyl silicone oil, derivatives thereof, and fluorine-substituted derivatives thereof; siloxanes such as disiloxane and hexamethyldisiloxane; and other compounds for use as conventional hydrophobing agents.

The process cartridge of the present invention comprises a development unit for developing a latent electrostatic image formed on a surface of a latent electrostatic image bearing member; and at least one of a latent electrostatic image bearing member, a charging unit for uniformly charging the latent electrostatic image bearing member, and a blade for wiping off a developer remained on a surface of the latent electrostatic image bearing member. The process cartridge is integrally incorporated in an image forming apparatus as to be detachable from the apparatus. In the process cartridge, the development unit contains the developer of the present invention. The latent electrostatic image bearing member, charging unit and blade for use herein can be appropriately selected from known members or devices. The process cartridge may further comprise other members.

The image forming apparatus of the present invention comprises a latent electrostatic image bearing member; a charging unit for uniformly charging the latent electrostatic image bearing member; an exposing unit for applying the latent electrostatic image bearing member with light imagewise to form a latent image; a development unit containing a developer and working to develop the latent image using the developer to form a toner image; and a transferring unit for transferring the toner image from the latent electrostatic image bearing member to a recording medium. In the apparatus, the developer is the developer of the present invention. The latent electrostatic image bearing member, charging unit, exposing unit, and transferring unit can be appropriately selected from known members or devices. The apparatus may further comprises other members.

The image forming process of the present invention comprises the steps of charging a latent electrostatic image bearing member; exposing the charged latent electrostatic image bearing member to light imagewise to form a latent electrostatic image; developing the latent electrostatic image by supplying a developer thereto to thereby form a visible toner image; and transferring the formed toner image to a transfer member, wherein the developer is the developer for latent electrostatic images of the present invention. The method can employ appropriate image forming processes, except with using the developer of the present invention.

The present invention will be illustrated in further detail with reference to several examples below, which are never intended to limit the scope of the present invention. All parts are by weight, unless otherwise specified.

EXAMPLE I

<Preparation Examples I>

Preparation Example I-1

A total of 10 parts of a methoxymethylated polyamide EF 30T (trade name, available from Nagase Chemtex Corporation) was mixed with and dissolved in 10 parts in terms of solid contents of a silanol-containing methylsilicone resin (SiOH content: 1% by weight, weight-average molecular weight Mw: 15,000) as a toluene solution having a solid content of 20% by weight. The solution was treated with acetic acid to be pH 4, followed by heating under reflex at 50° C. for 3 hours. A total of 5 parts carbon black (BP 2000) was added to the solid contents of the solution, and the mixture was diluted with 80 parts of methanol, 80 parts of acetone, and 80 parts of toluene. The diluted mixture was stirred and dispersed in a homogenizer and thereby yielded a coating liquid. A total of 5 parts of citric acid was added to the solid content of the coating liquid, the mixture was applied to a ferrite core material using a fluidized bed dryer to form a polyamide-silicone resin mixed film thereon. The resulting particles were heated and dried at 210° C. for 2 hours and thereby yielded Carrier A having a coating layer 0.6 μm thick.

The electric resistivity of the carrier can be determined in the following manner.

With reference to FIGURE, a sample carrier 13 was placed into a cell 11, i.e., a fluororesin container housing a pair of parallel flat electrodes 12*a* and 12*b* each having a distance therebetween of 12 mm and a surface 2 cm wide and 4 cm long. A direct-current voltage of 100 V or 500 V was applied between the two electrodes, and a direct-current resistance was determined with a high-resistance meter 4329A (trade name, available from Hewlett-Packard Japan, Ltd.). Thus, the electric resistivity in terms of log R Ω·cm was determined by calculation.

Carrier A had an electric resistivity in terms of log R of 14.2 Ω·cm at 50 V/mm and of 13.4 Ω·cm at 250 V/mm.

Preparation Example I-2

Carrier B having a coating layer 0.6 μm thick was prepared by the procedure of Preparation Example I-1, except that a methylphenyl silicone resin having a SiOH content of 6% by weight and a weight-average molecular weight Mw of 5,000 was used as the silicone resin. Carrier B had an electric resistivity in terms of log R of 14.1 Ω·cm at 50 V/mm and of 13.2 Ω·cm at 250 V/mm.

Preparation Example I-3

Carrier C having a coating layer 0.6 μm thick was prepared by the procedure of Preparation Example I-2, except that 7 parts in terms of solid contents of the methoxymethylated polyamide and 13 parts in terms of solid contents of the silanol-containing methylphenyl silicone resin were used. Carrier C had an electric resistivity in terms of log R of 15.4 Ω·cm at 50 V/mm and of 14.8 Ω·cm at 250 V/mm.

Preparation Example I-4

Carrier D having a coating layer 0.6 μm thick was prepared by the procedure of Preparation Example I-2, except that 13 parts in terms of solid contents of the methoxymethylated polyamide and 7 parts in terms of solid contents of the silanol-containing methylphenyl silicone resin were used. Carrier D had an electric resistivity in terms of log R of 14.0 Ω·cm at 50 V/mm and of 13.1 Ω·cm at 250 V/mm.

Preparation Example I-5

Carrier E having a coating layer 0.6 μm thick was prepared by the procedure of Preparation Example I-2, except that 2 parts in terms of solid contents of a solution of hexabutoxymethylated melamine in toluene and butanol was further added to the coating liquid to form a coating layer. Carrier E had an electric resistivity in terms of log R of 14.9 Ω·cm at 50 V/mm and of 13.2 Ω·cm at 250 V/mm.

Preparation Example I-6

Carrier F having a coating layer 0.6 μm thick was prepared by the procedure of Preparation Example I-2, except that 2 parts in terms of solid contents of a solution of hexabutoxymethylated benzoguanamine in toluene and butanol was further added to the coating liquid to form a coating layer. Carrier F had an electric resistivity in terms of log R of 15.1 Ω·cm at 50 V/mm and of 13.8 Ω·cm at 250 V/mm.

Preparation Example I-7

Carrier G having a coating layer 0.6 μm thick was prepared by the procedure of Preparation Example I-4, except that adipic acid was used instead of citric acid. Carrier G had an electric resistivity in terms of log R of 14.4 Ω·cm at 50 V/mm and of 14.0 Ω·cm at 250 V/mm.

Preparation Example I-8

Carrier H having a coating layer 0.6 μm thick was prepared by the procedure of Preparation Example I-5, except that the coating liquid was further mixed with 2 parts of a hydrophobic silica R 972 (trade name, available from Nippon Aerosil Co., Ltd.) by dispersing in a homogenizer for 20 minutes to form a coating layer. Carrier H had an electric resistivity in terms of log R of 14.7 Ω·cm at 50 V/mm and of 14.4 Ω·cm at 250 V/mm.

Preparation Example I-9

Carrier I having a coating layer 0.6 μm thick was prepared by the procedure of Preparation Example I-6, except that the coating liquid was further mixed with 1 part of alumina particles having an average particle diameter of 0.3 μm by dispersing in a homogenizer to form a coating layer. Carrier I had an electric resistivity in terms of log R of 15.2 Ω·cm at 50 V/mm and of 13.5 Ω·cm at 250 V/mm.

Preparation Example I-10

Carrier J having a coating layer 0.6 μm thick was prepared by the procedure of Preparation Example I-1, except that the silicone resin was not used. Carrier J had an electric resistivity in terms of log R of 13.7 Ω·cm at 50 V/mm and of 12.6 f cm at 250 V/mm.

Preparation Example I-11

Carrier K having a coating layer 0.6 μm thick was prepared by the procedure of Preparation Example I-1, except that the carrier particles were prepared without secondary heating at 210° C. Carrier K had an electric resistivity in terms of log R of 10.1 Ω·cm at 50 V/mm and of 8.2 Ω·cm at 250 V/mm.

Preparation Example I-12

Carrier L having a coating layer 0.6 μm thick was prepared by the procedure of Preparation Example I-1, except that a coating liquid prepared in the following manner was used as the coating liquid. Specifically, 10 parts of a methoxymethylated polyamide EF 30T (trade name, available from Nagase Chemtex Corporation) and 2 parts in terms of solid contents of a resol type phenolic resin PR 51283 (trade name, available from Sumitomo Bakelite Co., Ltd.) were dissolved in 80 parts of methanol. The solution was treated with acetic acid to be pH 4, followed by heating under reflux at 50° C. for 3 hours. A total of 5 parts of carbon black (BP 2000) and 5 parts of hydrophobic silica particles R 972 (trade name, available from Nippon Aerosil Co., Ltd.) were added to the solid contents of the solution, and the mixture was diluted with 80 parts of methanol and 80 parts of acetone. The diluted mixture was stirred and dispersed in a homogenizer and thereby yielded the coating liquid. Carrier L had an electric resistivity in terms of log R of 13.7 Ω·cm at 50 V/mm and of 12.9 Ω·cm at 250 V/mm.

Example I-1

A developer was prepared by mixing 93 parts of Carrier A prepared in Preparation Example I-1 and 7 parts of a black toner for IPSIO Color 8000 (trade name, available from Ricoh Company, Ltd.). The developer was charged to IPSIO Color 8000, and, as a printing test, a character image chart with an image area ratio of 12% was continuously printed out on 100,000 sheets using the machine.

[Evaluation]

Properties of the developer were determined in the following manner.

(1) Charge Amount and Toner Deposition on the Background Images

A small amount of a developer was sampled at the beginning of the 100,000-sheets printing test, and the charge amount of the carrier in the developer was determined. The toner deposition on the background of images and the charge amount of the developer after the completion of the 100,000-sheets printing test were also determined. In addition, the charge amounts of the carrier under conditions of 40° C. and 90% relative humidity (RH) and after storage for 1 week were determined.

The charge amount of the developer was determined according to a conventional blow off procedure using a small amount of the developer sampled from a sleeve of a development unit or sampled from the developer under the aforementioned conditions.

The toner deposition on the background of images was evaluated in four levels by visual observation according to the following criteria.

(2) Wear Rate of Coating Layer

The thickness of the coating layer of the carrier particles was determined at the beginning of (initial) and after the 100,000-sheets printing test by pulverizing the carrier particles and observing the section of the pulverized particle using a scanning electron microscope (SEM). The wear rate of the coating layer was determined according to the following equation:

$$\text{Wear rate } (\%) = 100 \times [(T1 - T2)/T1]$$

wherein "T1" is the initial thickness of the coating layer at the beginning of the printing test; and "T2" is the thickness of the coating layer after the printing test.

The uniformity of the coating layer of the carrier was evaluated in four levels by visual observation on a SEM photograph.

(3) Spent Amount

The spent amount was determined in the following manner.

The carrier (1 g) was separated from the developer and was dissolved in 10 g of a 1:1 mixture of methyl ethyl ketone (MEK) and toluene. The absorbance at 320 nm to 700 nm of supernatant of the solution was determined with a spectrophotometer. The average of the absorbances at individual wavelengths was defined as the spent amount, wherein the average absorbance of the 1:1 mixture of methyl ethyl ketone (MEK) and toluene was set at 100%.

The results are shown in Table 2. The symbols in Table 2 have the following meanings.

AA: Excellent

BB: Good

CC: Fair

DD: Failure (not acceptable)

Examples I-2 through I-9 and Comparative Examples I-1 through I-3

Developers were prepared and properties thereof were determined by the procedure of Example I-1, except that each of Carriers B through L was used instead of Carrier A. The results are shown in Table 2.

TABLE 2

| | Carrier | Initial charge amount of developer [−μc/g] | Initial toner deposition on background [−] | Charge amount of developer after printing [−μc/g] | Toner deposition on background after printing [−] | Charge amount at 40° C. and 90% R.H. [−μc/g] | Wear rate of coating layer (%) | Charge amount of developer after 1 week [−μc/g] | Spent amount |
|---|---|---|---|---|---|---|---|---|---|
| Example I-1 | Carrier A | 26.1 | AA | 18.9 | BB | 17.4 | 22% | 16.2 | 82.1 |
| Example I-2 | Carrier B | 24.5 | AA | 19.0 | BB | 12.4 | 16% | 15.2 | 79.4 |
| Example I-3 | Carrier C | 19.1 | BB | 16.4 | BB | 15.2 | 17% | 14.3 | 84.2 |
| Example I-4 | Carrier D | 28.2 | AA | 22.4 | BB | 19.5 | 18% | 16.7 | 83.4 |
| Example I-5 | Carrier E | 32.4 | AA | 29.1 | BB | 24.2 | 11% | 21.68 | 85.2 |
| Example I-6 | Carrier F | 30.6 | AA | 27.1 | BB | 21.1 | 11% | 17.91 | 84.4 |
| Example I-7 | Carrier G | 27.4 | BB | 26.2 | BB | 24.3 | 10% | 20.96 | 83.6 |
| Example I-8 | Carrier H | 29.1 | BB | 31.1 | AA | 25.1 | 4% | 24.88 | 82.1 |
| Example I-9 | Carrier I | 28.2 | AA | 29.2 | AA | 24.6 | 2% | 23.36 | 87.4 |
| Comp. Ex. I-1 | Carrier J | 21.8 | BB | 11.6 | DD | 2.4 | 74% | 3.4 | 65.2 |
| Comp. Ex. I-2 | Carrier K | 22.7 | CC | 8.1 | DD | +1.2 | 81% | 1.2 | 49.5 |
| Comp. Ex. I-3 | Carrier L | 16.1 | BB | 11.7 | DD | 8.7 | 12% | 9.36 | 70.3 |

As is described above in detail, the carriers of the present invention each have a coating layer comprising a condensation product of an alkoxyalkylated polyamide and a silicone resin that is reactive with the alkoxyalkylated polyamide and having excellent charging ability and wear resistance. By using a silanol-containing silicone resin as the silicone resin and allowing a catalyst to react in a secondary heating process after coating the coating liquid, the resulting carriers can have charges with higher durability and less variation depending on use environment and can thereby have excellent reliability.

EXAMPLE II

Preferred embodiments of the present invention, in which the N-alkoxyalkylated polyamides of Formula I wherein "n" is an integer of 1 to 5 are used, will be illustrated in detail below. All parts are by weight.

<Preparation Examples II>

Preparation Example II-1

A methoxymethylated polyamide EF 30T (trade name, available from Nagase Chemtex Corporation; substitution rate of methoxymethyl groups of 30%) was subjected to transetherification using isopropyl alcohol to yield a propoxymethylated polyamide (substitution rate of isopropoxymethyl groups of 28%). A total of 10 parts in terms of solid contents of the propoxymethylated polyamide as a methanol solution having a solid content of 20% was mixed and dissolved with 10 parts of a silanol-containing methyl silicone resin (SiOH content: 1% by weight, Mw: 15,000) as a toluene solution having a solid content of 20% by weight. The solution was treated with acetic acid to be pH 4, followed by heating under reflux at 50° C. for 3 hours. A total of 5 parts of carbon black (BP 2000) was added to solid contents of the solution. The mixture was diluted with 80 parts of isopropyl alcohol and 80 parts of toluene, was stirred and dispersed in a homogenizer and thereby yielded a coating liquid. A total of 5 parts of citric acid was added to solid contents of the coating liquid, the mixture was applied to a ferrite core material having a weight-average particle diameter of 35 μm using a fluidized bed dryer to form a polyamide-silicone resin mixed film thereon. The resulting particles were heated and dried at 210° C. for 2 hours and thereby yielded Carrier A having a coating layer 0.6 μm thick.

The electric resistivity of the carrier can be determined in the following manner.

With reference to FIGURE, a sample carrier 13 was charged into a cell 11, i.e., a fluororesin container housing a pair of parallel flat electrodes 12*a* and 12*b* with a distance between the electrodes of 12 mm and a surface 2 cm wide and 4 cm long. A direct-current voltage of 100 V or 500 V was applied between the two electrodes, and a direct-current resistance was determined with a high-resistance meter 4329A (trade name, available from Hewlett-Packard Japan, Ltd.). Thus, the electric resistivity in terms of log R Ω·cm was determined by calculation.

Carrier A had an electric resistivity in terms of log R of 14.3 Ω·cm at 50 V/mm and of 13.6 Ω·cm at 250 V/mm.

The yield of the carrier was determined in the following manner. A sample carrier was placed in a 63-μm-mesh sieve and was classified using a vibration sieving device. The yield was defined as the proportion of particles passing through the sieve.

The yield of Carrier A was 82%.

Preparation Example II-2

A methoxymethylated polyamide EF 30T (trade name, available from Nagase Chemtex Corporation) was subjected to transetherification using isobutyl alcohol to yield a butoxymethylated polyamide (substitution rate of butoxymethyl groups of 28%). A total of 10 parts in terms of solid contents of the butoxymethylated polyamide as a methanol solution having a solid content of 20% was mixed and dissolved with 10 parts in terms of solid contents of a silanol-containing methyl silicone resin (SiOH content: 1% by weight, Mw: 15,000) as a toluene solution having a solid content of 20% by weight. The solution was treated with acetic acid to be pH 4, followed by heating under reflux at 50° C. for 3 hours. A total of 5 parts of carbon black (BP 2000) was added to solid contents of the solution. The mixture was diluted with 80 parts of isobutyl alcohol and 80 parts of toluene, was stirred and dispersed in a homogenizer and thereby yielded a coating liquid. A total of 5 parts of citric acid was added to solid contents of the coating liquid, the mixture was applied to a ferrite core material having a weight-average particle diameter of 35 μm using a fluidized bed dryer to form a polyamide-silicone resin mixed film thereon. The resulting particles were heated and dried at 210° C. for 2 hours and thereby yielded Carrier B having a coating layer 0.6 μm thick.

The electric resistance log R (Ωcm) of Carrier B was determined by calculation by the procedure of Preparation Example II-1 at applied voltages of 100 V and 500 V, respectively. Carrier B had an electric resistivity in terms of log R of 14.2 Ωcm at 50 V/mm and 13.3 Ωcm at 250 V/mm.

The yield of the carrier was determined in the following manner. A sample carrier was placed in a 63-μm-mesh sieve and was classified using a vibration sieving device. The yield was defined as the proportion of particles passing through the sieve.

The yield of Carrier B was 94%.

Preparation Example II-3

Carrier C having a coating layer 0.6 μm thick was prepared by the procedure of Preparation Example II-1, except that a methylphenyl silicone resin having a SiOH content of 6% by weight and a weight-average molecular weight Mw of 5,000 was used as the silicone resin. Carrier C had an electric resistivity in terms of log R of 14.2 Ω·cm at 50 V/mm and of 13.2 Ω·cm at 250 V/mm.

The yield of Carrier C was 83%.

Preparation Example II-4

Carrier D having a coating layer 0.6 μm thick was prepared by the procedure of Preparation Example II-3, except that 7 parts in terms of solid contents of the propoxymethylated polyamide and 13 parts in terms of solid contents of the silanol-containing methylphenyl silicone resin were used. Carrier D had an electric resistivity in terms of log R of 15.2 Ω·cm at 50 V/mm and of 14.7 Ω·cm at 250 V/mm.

The yield of Carrier D was 84%.

Preparation Example II-5

Carrier E having a coating layer 0.6 μm thick was prepared by the procedure of Preparation Example II-3, except that 13 parts in terms of solid contents of the propoxymethylated polyamide and 7 parts in terms of solid contents of the silanol-containing methylphenyl silicone resin were used. Carrier E had an electric resistivity in terms of log R of 14.1 Ω·cm at 50 V/mm and of 13.0 Ω·cm at 250 V/mm.

The yield of Carrier E was 83%.

Preparation Example II-6

Carrier F having a coating layer 0.6 μm thick was prepared by the procedure of Preparation Example II-3, except that 2 parts in terms of solid contents of hexabutoxymethylated melamine as a solution in toluene and butanol was further added to the coating liquid to form a coating layer. Carrier F had an electric resistivity in terms of log R of 15.1 Ω·cm at 50 V/mm and of 13.3 Ω·cm at 250 V/mm.

The yield of Carrier F was 81%.

Preparation Example II-7

Carrier G having a coating layer 0.6 μm thick was prepared by the procedure of Preparation Example II-3, except that 2 parts in terms of solid contents of tetrabutoxymethylated benzoguanamine as a solution in toluene and butanol was further added to the coating liquid to form a coating layer. Carrier G had an electric resistivity in terms of log R of 15.2 Ω·cm at 50 V/mm and of 13.6 Ω·cm at 250 V/mm.

The yield of Carrier G was 83%.

Preparation Example II-8

Carrier H having a coating layer 0.6 μm thick was prepared by the procedure of Preparation Example II-5, except that adipic acid was used instead of citric acid. Carrier H had an electric resistivity in terms of log R of 14.6 Ω·cm at 50 V/mm and of 14.1 Ω·cm at 250 V/mm.

The yield of Carrier H was 80%.

Preparation Example II-9

Carrier I having a coating layer 0.6 μm thick was prepared by the procedure of Preparation Example II-6, except that the coating liquid was further mixed with 20 parts of a hydrophobic silica R 972 (trade name, available from Nippon Aerosil Co., Ltd.) by dispersing in a homogenizer for 20 minutes to form a coating layer. Carrier I had an electric resistivity in terms of log R of 14.9 Ω·cm at 50 V/mm and of 14.3 Ω·cm at 250 V/mm.

The yield of Carrier I was 81%.

Preparation Example II-10

Carrier J having a coating layer 0.6 μm thick was prepared by the procedure of Preparation Example II-7, except that the coating liquid was further mixed with 10 parts of alumina particles having an average particle diameter of 0.3 μm by dispersing in a homogenizer to form a coating layer. Carrier J had an electric resistivity in terms of log R of 15.1 Ω·cm at 50 V/mm and of 13.4 Ω·cm at 250 V/mm.

The yield of Carrier J was 84%.

Preparation Example II-11

A total of 10 parts in terms of solid contents of a methoxymethylated polyamide EF 30T (trade name, available from Nagase Chemtex Corporation) as a methanol solution having a solid content of 20% by weight was mixed and dissolved with 10 parts in terms of solid contents of a silanol-containing methylsilicone resin (SiOH content: 1% by weight, weight-average molecular weight Mw of 15,000) as a toluene solution having a solid content of 20% by weigh. The solution was treated with acetic acid to be pH 4, followed by heating under reflex at 50° C. for 3 hours. A total of 5 parts carbon black (BP 2000) was added to solid contents of the solution, and the mixture was diluted with 80 parts of acetone and 80 parts of toluene. The diluted mixture was stirred and dispersed in a homogenizer and thereby yielded a coating liquid. A total of 5 parts of citric acid was added to solid contents of the coating liquid, the mixture was applied to a ferrite core material using a fluidized bed dryer to form a polyamide-silicone resin mixed film thereon. The resulting particles were heated and dried at 210° C. for 2 hours and thereby yielded Carrier K having a coating layer 0.6 μm thick.

Carrier K had an electric resistivity in terms of log R of 14.3 Ω·cm at 50 V/mm and of 13.5 Ω·cm at 250 V/mm.

The yield of Carrier K was 55%.

Preparation Example II-12

A methoxymethylated polyamide EF 30T (trade name, available from Nagase Chemtex Corporation) was subjected to transetherification using n-octyl alcohol to yield an octyloxymethylated polyamide (substitution rate of octyloxymethyl groups of 27%). A total of 10 parts in terms of solid contents of the octyloxymethylated polyamide as an n-octyl solution having a solid content of 20% was mixed and dissolved with 10 parts in terms of solid contents of a silanol-containing methyl silicone resin (SiOH content: 1% by weight, Mw: 15,000) as a toluene solution having a solid content of 20% by weight. The solution was treated with acetic acid to be pH 4, followed by heating under reflux at 50° C. for 3 hours. A total of 5 parts of carbon black (BP 2000) was added to solid contents of the solution. The mixture was diluted with 80 parts of n-octyl alcohol and 80 parts of toluene, was stirred and dispersed in a homogenizer and thereby yielded a coating liquid. A total of 5 parts of citric acid was added to solid contents of the coating liquid, the mixture was applied to a ferrite core material having a weight-average particle diameter of 35 μm using a fluidized bed dryer to form a polyamide-silicone resin mixed film thereon. The resulting particles were heated and dried at 210° C. for 2 hours and thereby yielded Carrier L having a coating layer 0.6 μm thick.

Carrier L had an electric resistivity in terms of log R of 14.5 Ω·cm at 50 V/mm and of 13.6 Ω·cm at 250 V/mm.

The yield of Carrier K was 93%.

Preparation Example II-13

Carrier M having a coating layer 0.6 μm thick was prepared by the procedure of Preparation Example II-1, except that the silicone resin was not used. Carrier M had an electric resistivity in terms of log R of 13.8 Ω·cm at 50 V/mm and of 12.5 Ω·cm at 250 V/mm.

The yield of Carrier M was 65%.

Preparation Example II-14

Carrier N having a coating layer 0.6 μm thick was prepared by the procedure of Preparation Example II-1, except that the carrier particles were prepared without heating at 210° C. Carrier N had an electric resistivity in terms of log R of 10.4 Ω·cm at 50 V/mm and of 8.3 Ω·cm at 250 V/mm.

The yield of Carrier N was 85%.

Preparation Example II-15

Carrier O having a coating layer 0.6 μm thick was prepared by the procedure of Preparation Example II-1, except that a coating liquid prepared in the following manner was used as the coating liquid. Specifically, 10 parts of the propoxymethylated polyamide prepared in Preparation Example II-1 and 2 parts in terms of solid contents of a resol type phenolic resin PR 51283 (trade name, available from Sumitomo Bakelite Co., Ltd.) were dissolved in 80 parts of methanol. The solution was treated with acetic acid to be pH 4, followed by heating under reflux at 50° C. for 3 hours. A total of 5 parts carbon black (BP 2000) and 5 parts of hydrophobic silica particles R 972 (trade name, available from Nippon Aerosil Co., Ltd.) were added to solid contents of the solution, and the mixture was diluted with 80 parts of isopropyl alcohol and 80 parts of acetone. The diluted mixture was stirred and dispersed in a homogenizer and thereby yielded the coating liquid. Carrier O had an electric resistivity in terms of log R of 13.5 Ω·cm at 50 V/mm and of 13.0 Ω·cm at 250 V/mm.

The yield of Carrier O was 80%.

Example II-1

A developer was prepared by mixing 93 parts of Carrier A prepared in Preparation Example II-1 and 7 parts of a black toner for IPSIO Color 8000 (trade name, available from Ricoh Company, Ltd.). The developer was charged to IPSIO Color 8000, and, as a printing test, a character image chart with an image area ratio of 12% was continuously printed out on 100,000 sheets using the machine.

[Evaluation]

Properties of the developer were determined in the following manner.

(1) Charge Amount and Toner Deposition on the Background Images

A small amount of the developer was sampled at the beginning of the 100,000-sheets printing test, and the charge amount of the carrier in the developer was determined. The toner deposition on the background of images and the charge amount of the developer after the completion of the 100,000-sheets printing test were also determined. In addition, the charge amounts of the carrier under conditions of 40° C. and 90% relative humidity (RH) and after storage for 1 week were determined.

The charge amount of the developer was determined according to a conventional blow off procedure using a small amount of the developer sampled from a sleeve of the development unit or sampled from the developer under the aforementioned conditions.

The toner deposition on the background of images was evaluated in four levels by visual observation according to the following criteria.

(2) Wear Rate of Coating Layer

The thickness of the coating layer of the carrier particles was determined at the beginning of (initial) and after the 100,000-sheets printing test by pulverizing the carrier particles and observing the section of the pulverized particle using a scanning electron microscope (SEM). The wear rate of the coating layer was determined according to the following equation:

$$\text{Wear rate } (\%) = 100 \times [(T1 - T2)/T1]$$

wherein T1 is the initial thickness of the coating layer before the printing test; and T2 is the thickness of the coating layer after the printing test.

The uniformity of the coating layer of the carrier was evaluated in four levels by visual observation on a SEM photograph.

(3) Spent Amount

The spent amount was determined in the following manner.

The carrier (1 g) was separated from the developer, was dissolved in 10 g of a 1:1 mixture of methyl ethyl ketone (MEK) and toluene. The absorbance at 320 nm to 700 nm of supernatant of the solution was determined with a spectrophotometer. The average of the absorbances at individual wavelengths was defined as the spent amount, wherein the average absorbance of the 1:1 mixture of methyl ethyl ketone (MEK) and toluene was set at 100%.

The results are shown in Table 3. The symbols in Table 3 have the following meanings.

AA: Excellent

BB: Good

CC: Fair

DD: Failure (not acceptable)

Examples II-2 through II-12 and Comparative Examples II-1 through II-3

Developers were prepared and properties thereof were determined by the procedure of Example II-1, except that each of Carriers B through O was used instead of Carrier A as shown in Table 3. The results are shown in Table 3.

TABLE 3

| | Carrier | Yield (%) | Initial charge amount of developer [−μc/g] | Initial toner deposition on background | Charge amount of developer after printing [−μc/g] | Toner deposition on background after printing |
|---|---|---|---|---|---|---|
| Example II-1 | Carrier A | 82 | 27.9 | AA | 22.0 | BB |
| Example II-2 | Carrier B | 94 | 26.3 | AA | 22.4 | BB |
| Example II-3 | Carrier C | 83 | 26.2 | AA | 21.0 | BB |
| Example II-4 | Carrier D | 84 | 20.1 | BB | 16.0 | BB |
| Example II-5 | Carrier E | 83 | 29.6 | AA | 23.7 | BB |
| Example II-6 | Carrier F | 81 | 34.1 | AA | 30.6 | BB |
| Example II-7 | Carrier G | 83 | 32.1 | AA | 27.0 | BB |
| Example II-8 | Carrier H | 80 | 29.4 | BB | 27.3 | BB |
| Example II-9 | Carrier I | 81 | 27.0 | BB | 29.3 | AA |
| Example II-10 | Carrier J | 84 | 29.7 | AA | 30.2 | AA |
| Example II-11 | Carrier K | 55 | 26.3 | AA | 18.7 | BB |
| Example II-12 | Carrier L | 93 | 25.0 | BB | 11.2 | DD |
| Comp. Ex. II-1 | Carrier M | 65 | 22.8 | BB | 14.6 | DD |
| Comp. Ex. II-2 | Carrier N | 85 | 23.5 | CC | 9.1 | DD |
| Comp. Ex. II-3 | Carrier O | 80 | 16.4 | BB | 10.3 | DD |

| | Charge amount at 40° C. and 90% R.H. [−μc/g] | Wear rate of coating layer (%) | Charge amount of developer after 1 week [−μc/g] | Spent amount (%) | Uniformity of coating layer |
|---|---|---|---|---|---|
| Example II-1 | 21.6 | 23 | 23.1 | 84.1 | BB |
| Example II-2 | 20.3 | 24 | 21.5 | 85.2 | AA |
| Example II-3 | 13.7 | 15 | 17.0 | 82.0 | BB |
| Example II-4 | 15.1 | 16 | 15.0 | 85.6 | BB |

TABLE 3-continued

| | | | | | |
|---|---|---|---|---|---|
| Example II-5 | 20.3 | 17 | 23.5 | 84.7 | BB |
| Example II-6 | 25.1 | 10 | 23.6 | 86.3 | BB |
| Example II-7 | 20.9 | 12 | 19.3 | 85.1 | BB |
| Example II-8 | 24.8 | 9 | 22.0 | 84.5 | BB |
| Example II-9 | 23.2 | 5 | 21.6 | 83.7 | BB |
| Example II-10 | 25.5 | 3 | 25.1 | 86.9 | BB |
| Example II-11 | 18.6 | 21 | 15.9 | 82.7 | DD |
| Example II-12 | 22.4 | 58 | 21.6 | 39.4 | AA |
| Comp. Ex. II-1 | 6.3 | 76 | 9.8 | 63.0 | CC |
| Comp. Ex. II-2 | 2.1 | 82 | 6.2 | 35.1 | BB |
| Comp. Ex. II-3 | 8.3 | 13 | 8.9 | 68.6 | BB |

As is described above in detail, by using the N-alkoxyalkylated polyamides of Formula I wherein "n" is an integer of 1 to 5, the carriers of the present invention each have a coating layer comprising a condensation product of an alkoxyalkylated polyamide that is soluble in a higher alcohol and a silicone resin that is reactive with the polyamide and can be prepared in high yields. In addition, the carriers have excellent charging ability and wear resistance by virtue of the coating layer. By using a silicone resin having a silanol group and/or a hydrolyzable group as the silicone resin and allowing a catalyst to react in a secondary heating process after coating the coating liquid, the resulting carriers can have charges with higher durability and less variation depending on use environment and can thereby have excellent reliability and improved productivity.

EXAMPLE III

Preferred embodiments of the present invention, in which the coating layer comprises a monofunctional or bifunctional silane compound having a terminal phenyl group or a terminal group represented by the formula: $C_nH_{2n+1}$—, wherein "n" is an integer of 1 to 4, will be illustrated in detail below. All parts are by weight.

<Preparation Examples III>

Preparation Example III-1

A total of 10 parts of a methoxymethylated polyamide EF 30T (trade name, available from Nagase Chemtex Corporation) was mixed with and dissolved in 10 parts in terms of solid contents of a silanol-containing methyl silicone resin (SiOH content: 1% by weight, weight-average molecular weight Mw of 15,000) as a toluene solution having a solid content of 20% by weight. The solution was treated with acetic acid to be pH 4, followed by heating under reflex at 50° C. for 3 hours. A total of 5 parts of ethoxytrimethylsilane LS-875 (trade name, available from Shin-Etsu Chemical Co., Ltd.) and 5 parts carbon black (BP 2000) were added to solid contents of the solution, and the mixture was diluted with 80 parts of methanol, 80 parts of acetone, and 80 parts of toluene. The diluted mixture was stirred and dispersed in a homogenizer and thereby yielded a coating liquid. A total of 5 parts of citric acid was added to solid contents of the coating liquid, the mixture was applied to a ferrite core material using a fluidized bed dryer to form a polyamide-silicone resin mixed film thereon. The resulting particles were heated and dried at 210° C. for 2 hours and thereby yielded Carrier A having a coating layer 0.6 μm thick. The thickness of the coating layer was determined by pulverizing the carrier particles and observing pulverized particles with a scanning electron microscope (SEM).

The electric resistivity of the carrier can be determined in the following manner.

With reference to FIGURE, a sample carrier 13 was charged into a cell 11, i.e., a fluororesin container housing a pair of parallel flat electrodes 12*a* and 12*b* with a distance between the electrodes of 12 mm and a surface 2 cm wide and 4 cm long. A direct-current voltage of 100 V or 500 V was applied between the two electrodes, and a direct-current resistance was determined with a high-resistance meter 4329A (trade name, available from Hewlett-Packard Japan, Ltd.). Thus, the electric resistivity in terms of log R Ω·cm was determined by calculation.

Carrier A had an electric resistivity in terms of log R of 14.2 Ω·cm at 50 V/mm and of 13.4 Ω·cm at 250 V/mm.

The yield of the carrier was determined in the following manner. A sample carrier was placed in a 63-μm-mesh sieve and was classified using a vibration sieving device. The yield was defined as the proportion of particles passing through the sieve.

The yield of Carrier A was 87%.

Preparation Example III-2

Carrier B having a coating layer 0.6 μm thick was prepared by the procedure of Preparation Example III-1, except that diethoxydiethylsilane LS-2400 (trade name, available from Shin-Etsu Chemical Co., Ltd.) was used instead of the ethoxytrimethylsilane. Carrier B had an electric resistivity in terms of log R of 14.1 Ω·cm at 50 V/mm and of 13.3 Ω·cm at 250 V/mm. The yield of Carrier B was 85%.

Preparation Example III-3

Carrier C having a coating layer 0.6 μm thick was prepared by the procedure of Preparation Example III-1, except that diethoxydiphenylsilane LS-5990 (trade name, available from Shin-Etsu Chemical Co., Ltd.) was used instead of the ethoxytrimethylsilane. Carrier C had an electric resistivity in terms of log R of 14.3 Ω·cm at 50 V/mm and of 13.7 Ω·cm at 250 V/mm. The yield of Carrier C was 90%.

Preparation Example III-4

Carrier D having a coating layer 0.6 μm thick was prepared by the procedure of Preparation Example III-1, except that dimethoxydimethylsilane LS-520 (trade name, available from Shin-Etsu Chemical Co., Ltd.) was used instead of the ethoxytrimethylsilane. Carrier D had an electric resistivity in terms of log R of 14.6 Ω·cm at 50 V/mm and of 13.5 Ω·cm at 250 V/mm. The yield of Carrier D was 88%.

Preparation Example III-5

Carrier E having a coating layer 0.6 μm thick was prepared by the procedure of Preparation Example III-1, except that trimethylsilanol LS-310 (trade name, available from Shin-Etsu Chemical Co., Ltd.) was used instead of the ethoxytrimethylsilane. Carrier E had an electric resistivity in terms of log R of 14.6 Ω·cm at 50 V/mm and of 13.4 Ω·cm at 250 V/mm. The yield of Carrier E was 89%.

Preparation Example III-6

Carrier F having a coating layer 0.6 μm thick was prepared by the procedure of Preparation Example III-1, except that a methylphenyl silicone resin having a SiOH content of 6% by weight and a weight-average molecular weight Mw of 5,000 was used as the silicone resin. Carrier F had an electric resistivity in terms of log R of 14.1 Ω·cm at 50 V/mm and of 13.2 Ω·cm at 250 V/mm. The yield of Carrier F was 87%.

Preparation Example III-7

Carrier G having a coating layer 0.6 μm thick was prepared by the procedure of Preparation Example III-6, except that 7 parts in terms of solid contents of the methoxymethylated polyamide and 13 parts in terms of solid contents of the silanol-containing methylphenyl silicone resin were used. Carrier G had an electric resistivity in terms of log R of 15.4 Ω·cm at 50 V/mm and of 14.8 Ω·cm at 250 V/mm. The yield of Carrier G was 88%.

Preparation Example III-8

Carrier H having a coating layer 0.6 μm thick was prepared by the procedure of Preparation Example III-6, except that 13 parts in terms of solid contents of the methoxymethylated polyamide and 7 parts in terms of solid contents of the silanol-containing methylphenyl silicone resin were used. Carrier H had an electric resistivity in terms of log R of 14.0 Ω·cm at 50 V/mm and of 13.1 Ω·cm at 250 V/mm. The yield of Carrier H was 85%.

Preparation Example III-9

Carrier I having a coating layer 0.6 μm thick was prepared by the procedure of Preparation Example III-6, except that 2 parts in terms of solid contents of hexabutoxymethylated melamine as a solution in toluene and butanol was further added to the coating liquid to form a coating layer. Carrier I had an electric resistivity in terms of log R of 14.9 Ω·cm at 50 V/mm and of 13.2 Ω·cm at 250 V/mm. The yield of Carrier I was 86%.

Preparation Example III-10

Carrier I having a coating layer 0.6 μm thick was prepared by the procedure of Preparation Example III-6, except that 2 parts in terms of solid contents of tetrabutoxymethylated benzoguanamine as a solution in toluene and butanol was further added to the coating liquid to form a coating layer. Carrier J had an electric resistivity in terms of log R of 15.1 Ω·cm at 50 V/mm and of 13.8 Ω·cm at 250 V/mm. The yield of Carrier J was 87%.

Preparation Example III-11

Carrier K having a coating layer 0.6 μm thick was prepared by the procedure of Preparation Example III-6, except that adipic acid was used instead of citric acid. Carrier K had an electric resistivity in terms of log R of 14.4 Ω·cm at 50 V/mm and of 14.0 Ω·cm at 250 V/mm. The yield of Carrier K was 82%.

Preparation Example III-12

Carrier L having a coating layer 0.6 μm thick was prepared by the procedure of Preparation Example III-6, except that the coating liquid was further mixed with 20 parts of a hydrophobic silica R 972 (trade name, available from Nippon Aerosil Co., Ltd.) by dispersing in a homogenizer for 20 minutes to form the coating layer. Carrier L had an electric resistivity in terms of log R of 14.7 Ω·cm at 50 V/mm and of 14.4 Ω·cm at 250 V/mm. The yield of Carrier L was 88%.

Preparation Example III-13

Carrier M having a coating layer 0.6 μm thick was prepared by the procedure of Preparation Example III-6, except that the coating liquid was further mixed with 10 parts of alumina particles having an average particle diameter of 0.3 μm by dispersing in a homogenizer to form the coating layer. Carrier M had an electric resistivity in terms of log R of 15.2 Ω·cm at 50 V/mm and of 13.5 Ω·cm at 250 V/mm. The yield of Carrier M was 88%.

Preparation Example III-14

Carrier N having a coating layer 0.6 μm thick was prepared by the procedure of Preparation Example III-1, except that the silicone resin was not used. Carrier N had an electric resistivity in terms of log R of 13.7 Ω·cm at 50 V/mm and of 12.6 Ω·cm at 250 V/mm. The yield of Carrier N was 62%.

Preparation Example III-15

Carrier O having a coating layer 0.6 μm thick was prepared by the procedure of Preparation Example III-1, except that the carrier was not heated at 210° C. Carrier O had an electric resistivity in terms of log R of 10.1 Ω·cm at 50 V/mm and of 8.2 Ω·cm at 250 V/mm. The yield of Carrier O was 87%.

Preparation Example III-16

Carrier P having a coating layer 0.6 μm thick was prepared by the procedure of Preparation Example III-1, except that a coating liquid prepared in the following manner was used as the coating liquid. Specifically, 10 parts of a methoxymethylated polyamide EF 30T (trade name, available from Nagase Chemtex Corporation) and 2 parts in terms of solid contents of a resol type phenolic resin PR 51283 (trade name, available from Sumitomo Bakelite Co., Ltd.) were dissolved in 80 parts of methanol. The solution was treated with acetic acid to be pH 4, followed by heating under reflux at 50° C. for 3 hours. A total of 5 parts of ethoxytrimethylsilane LS-875 (trade name, available from Shin-Etsu Chemical Co., Ltd.), 5 parts carbon black (BP 2000) and 20 parts of hydrophobic silica particles R 972 (trade name, available from Nippon Aerosil Co., Ltd.) were added to solid contents of the solution, and the mixture was diluted with 80 parts of methanol and 80 parts of acetone. The diluted mixture was stirred and dispersed in a homogenizer and thereby yielded the coating liquid. Carrier P had an electric resistivity in terms of log R of 13.7 Ω·cm at 50 V/mm and of 12.9 Ω·cm at 250 V/mm. The yield of Carrier P was 85%.

Example III-1

A developer was prepared by mixing 93 parts of Carrier A prepared in Preparation Example III-1 and 7 parts of a black toner for IPSIO Color 8000 (trade name, available from Ricoh Company, Ltd.). The developer was charged to IPSIO Color 8000, and, as a printing test, a character image chart with an image area ratio of 12% was continuously printed out on 100,000 sheets using the machine.

[Evaluation]

Properties of the developer were determined in the following manner.

(1) Charge Amount and Toner Deposition on the Background Images

A small amount of the developer was sampled at the beginning of the 100,000-sheets printing test, and the charge amount of the carrier in the developer was determined. The toner deposition on the background of images and the charge amount of the developer after the completion of the 100,000-sheets printing test were also determined. The charge amounts of the carrier under conditions of 40° C. and 90% relative humidity (RH) and after storage for 1 week were determined.

The charge amount of the developer was determined according to a conventional blow off procedure using a small amount of the developer sampled from a sleeve of the development device or sampled from the developer under the aforementioned conditions.

The toner deposition on the background of images was evaluated in four levels by visual observation according to the following criteria.

Examples III-2 through III-13 and Comparative Examples III-1 through III-3

Developers were prepared and properties thereof were determined by the procedure of Example III-1, except that each of Carriers B through P was used instead of Carrier A as shown in Table 4. The results are shown in Table 4.

TABLE 4

| | Carrier | Initial charge amount of developer [−μc/g] | Initial toner deposition on background | Charge amount of developer after printing [−μc/g] | Initial toner deposition on background | Charge amount at 40° C. and 90% R.H. [−μc/g] | Wear rate of coating layer (%) | Charge amount of developer after 1 week [−μc/g] | Spent amount (%) |
|---|---|---|---|---|---|---|---|---|---|
| Example III-1 | Carrier A | 26.5 | AA | 19.6 | AA | 17.9 | 18 | 16.8 | 82.4 |
| Example III-2 | Carrier B | 26.3 | AA | 19.9 | AA | 17.2 | 19 | 16.5 | 82.7 |
| Example III-3 | Carrier C | 26.1 | AA | 19.2 | AA | 17.7 | 17 | 16.4 | 82.3 |
| Example III-4 | Carrier D | 26.4 | AA | 19.6 | AA | 17.8 | 18 | 16.9 | 82.8 |
| Example III-5 | Carrier E | 26.5 | AA | 19.5 | AA | 17.6 | 18 | 16.8 | 82.9 |
| Example III-6 | Carrier F | 24.1 | AA | 19.5 | AA | 12.6 | 12 | 15.6 | 79.1 |
| Example III-7 | Carrier G | 19.2 | BB | 16.8 | AA | 15.8 | 13 | 14.9 | 84.4 |
| Example III-8 | Carrier H | 28.1 | AA | 22.6 | AA | 19.8 | 15 | 17.2 | 83.2 |
| Example III-9 | Carrier I | 32.6 | AA | 29.5 | AA | 24.8 | 8 | 22.4 | 85.4 |
| Example III-10 | Carrier J | 30.4 | AA | 27.8 | AA | 21.5 | 9 | 18.3 | 84.2 |
| Example III-11 | Carrier K | 27.1 | BB | 26.8 | AA | 24.9 | 8 | 21.5 | 83.1 |
| Example III-12 | Carrier L | 29.6 | BB | 31.7 | AA | 25.7 | 2 | 25.2 | 82.6 |
| Example III-13 | Carrier M | 28.8 | AA | 29.6 | AA | 25.2 | 1 | 24.0 | 87.2 |
| Comp. Ex. III-1 | Carrier N | 21.2 | BB | 11.9 | DD | 2.6 | 65 | 3.9 | 65.4 |
| Comp. Ex. III-2 | Carrier O | 22.1 | CC | 8.7 | DD | 1.7 | 70 | 1.8 | 49.3 |
| Comp. Ex. III-3 | Carrier P | 16.7 | BB | 12.1 | DD | 9.2 | 8 | 9.4 | 70.5 |

(2) Wear Rate of Coating Layer

The thickness of the coating layer of the carrier particles was determined at the beginning of (initial) and after the 100,000-sheets printing test by pulverizing the carrier particles and observing the section of the pulverized particle using a scanning electron microscope (SEM). The wear rate of the coating layer was determined according to the following equation:

$$\text{Wear rate } (\%)=100\times[(T1-T2)/T1]$$

wherein T1 is the initial thickness of the coating layer before the printing test; and T2 is the thickness of the coating layer after the printing test.

The uniformity of the coating layer of the carrier was evaluated in four levels by visual observation on a SEM photograph.

(3) Spent Amount

The spent amount was determined in the following manner.

The carrier (1 g) was separated from the developer, was dissolved in 10 g of a 1:1 mixture of methyl ethyl ketone (MEK) and toluene. The absorbance at 320 nm to 700 nm of supernatant of the solution was determined with a spectrophotometer. The average of the absorbances at individual wavelengths was defined as the spent amount, wherein the average absorbance of the 1:1 mixture of methyl ethyl ketone (MEK) and toluene was set at 100%.

The results are shown in Table 4. The symbols in Table 4 have the following meanings.

AA: Excellent

BB: Good

CC: Fair

DD: Failure (not acceptable)

As is described above in detail, the carriers of the present invention each have a coating layer comprising a condensation product of an alkoxyalkylated polyamide and a silicone resin that is reactive with the polyamide and having excellent charging ability and wear resistance.

By using a silicone resin having a silanol group and/or a hydrolyzable group as the silicone resin, using a monofunctional or bifunctional silane compound having a terminal phenyl group and/or a terminal group represented by the formula: $C_nH_{2n+1}$—, wherein "n" is an integer of 1 to 4, and, preferably, allowing a catalyst to react in a secondary heating process after coating the coating liquid, the resulting carriers can have charges with higher durability and less variation depending on use environment and can thereby have excellent reliability and improved productivity.

The present invention can further provide a developer using the carrier, and a process cartridge having a development unit using the developer.

EXAMPLE IV

Preferred embodiments of the present invention, in which the coating layer further comprises an aminosilane coupling agent, will be illustrated in detail below with reference to several examples, which are not intended to limit the scope of the present invention. All parts are by weight, unless otherwise specified.

<Preparation Examples IV>

Preparation Example IV-1

A total of 10 parts of a methoxymethylated polyamide EF 30T (trade name, available from Nagase Chemtex Corporation) was mixed with and dissolved in 10 parts in terms of solid contents of a silanol-containing methyl silicone resin (SiOH content: 1% by weight, weight-average molecular weight Mw of 15,000) as a toluene solution having a solid content of 20% by weight. The solution was treated with acetic acid to be pH 4, followed by heating under reflex at 50° C. for 3 hours. A total of 1 part of 3-(2-aminoethylaminopropyl)trimethoxysilane and 5 parts of carbon black (BP 2000) were added to solid contents of the solution, and the mixture was diluted with 80 parts of methanol, 80 parts of acetone, and 80 parts of toluene. The diluted mixture was stirred and dispersed in a homogenizer and thereby yielded a coating liquid. A total of 5 parts of citric acid was added to solid contents of the coating liquid, the mixture was applied to a ferrite core material using a fluidized bed dryer to form a polyamide-silicone resin mixed film thereon. The resulting particles were heated and dried at 210° C. for 2 hours and thereby yielded Carrier A having a coating layer 0.6 μm thick.

The electric resistivity of the carrier can be determined in the following manner.

With reference to FIGURE, a sample carrier 13 was charged into a cell 11, i.e., a fluororesin container housing a pair of parallel flat electrodes 12*a* and 12*b* with a distance between the electrodes of 12 mm and a surface 2 cm wide and 4 cm long. A direct-current voltage of 100 V or 500 V was applied between the two electrodes, and a direct-current resistance was determined with a high-resistance meter 4329A (trade name, available from Hewlett-Packard Japan, Ltd.). Thus, the electric resistivity in terms of log R (Ω·cm) was determined by calculation.

Carrier A had an electric resistivity in terms of log R of 14.5 Ω·cm at 50 V/mm and of 13.2 Ω·cm at 250 V/mm.

The yield of the carrier was determined in the following manner. A sample carrier was placed in a 63-μm-mesh sieve and was classified using a vibration sieving device. The yield was defined as the proportion of particles passing through the sieve.

The yield of Carrier A was 86%.

Preparation Example IV-2

Carrier B was prepared by the procedure of Preparation Example IV-1, except that 3-aminopropyltriethoxysilane was used instead of 3-(2-aminoethylaminopropyl) trimethoxysilane. Carrier B had an electric resistivity in terms of log R of 14.6 Ω·cm at 50 V/mm and of 13.6 Ω·cm at 250 V/mm. The yield of Carrier B was 84%.

Preparation Example IV-3

Carrier C was prepared by the procedure of Preparation Example IV-1, except that dibutylaminopropyltrimethoxysilane was used instead of 3-(2-aminoethylaminopropyl) trimethoxysilane. Carrier C had an electric resistivity in terms of log R of 14.1 Ω·cm at 50 V/mm and of 13.8 Ω·cm at 250 V/mm. The yield of Carrier C was 77%.

Preparation Example IV-4

Carrier D was prepared by the procedure of Preparation Example IV-1, except that a methylphenyl silicone resin having a SiOH content of 6% by weight and a weight-average molecular weight Mw of 5,000 was used as the silicone resin. Carrier D had an electric resistivity in terms of log R of 14.2 Ω·cm at 50 V/mm and of 13.1 Ω·cm at 250 V/mm. The yield of Carrier D was 85%.

Preparation Example IV-5

Carrier E was prepared by the procedure of Preparation Example IV-4, except that 7 parts in terms of solid contents of the methoxymethylated polyamide and 13 parts in terms of solid contents of the silanol-containing methylphenyl silicone resin were used. Carrier E had an electric resistivity in terms of log R of 15.2 Ω·cm at 50 V/mm and of 14.6 Ω·cm at 250 V/mm. The yield of Carrier E was 86%.

Preparation Example IV-6

Carrier F was prepared by the procedure of Preparation Example IV-4, except that 13 parts in terms of solid contents of the methoxymethylated polyamide and 7 parts in terms of solid contents of the silanol-containing methylphenyl silicone resin were used. Carrier F had an electric resistivity in terms of log R of 14.0 Ω·cm at 50 V/mm and of 13.0 Ω·cm at 250 V/mm. The yield of Carrier F was 84%.

Preparation Example IV-7

Carrier G was prepared by the procedure of Preparation Example IV-4, except that 2 parts in terms of solid contents of hexabutoxymethylated melamine as a solution in toluene and butanol was further added to the coating liquid to form a coating layer. Carrier G had an electric resistivity in terms of log R of 14.6 Ω·cm at 50 V/mm and of 13.3 Ω·cm at 250 V/mm. The yield of Carrier G was 84%.

Preparation Example IV-8

Carrier H was prepared by the procedure of Preparation Example IV-4, except that 2 parts in terms of solid contents of tetrabutoxymethylated benzoguanamine as a solution in toluene and butanol was further added to the coating liquid to form a coating layer. Carrier H had an electric resistivity in terms of log R of 15.2 Ω·cm at 50 V/mm and of 13.9 Ω·cm at 250 V/mm. The yield of Carrier H was 88%.

Preparation Example IV-9

Carrier I was prepared by the procedure of Preparation Example IV-6, except that adipic acid was used instead of citric acid. Carrier I had an electric resistivity in terms of log R of 14.5 Ω·cm at 50 V/mm and of 13.9 Ω·cm at 250 V/mm. The yield of Carrier I was 84%.

Preparation Example IV-10

Carrier J was prepared by the procedure of Preparation Example IV-7, except that the coating liquid was further mixed with 2 parts of a hydrophobic silica R 972 (trade name, available from Nippon Aerosil Co., Ltd.) relative to solid contents of the resin by dispersing in a homogenizer for 20 minutes to form a coating layer. Carrier J had an electric resistivity in terms of log R of 14.6 Ω·cm at 50 V/mm and of 14.3 Ω·cm at 250 V/mm. The yield of Carrier J was 87%.

Preparation Example IV-11

Carrier K was prepared by the procedure of Preparation Example IV-8, except that the coating liquid was further mixed with 1 part of alumina particles having an average particle diameter of 0.3 μm by dispersing in a homogenizer to form a coating layer. Carrier K had an electric resistivity in terms of log R of 15.4 Ω·cm at 50 V/mm and of 13.6 Ω·cm at 250 V/mm. The yield of Carrier K was 88%.

Preparation Example IV-12

Carrier L was prepared by the procedure of Preparation Example IV-1, except that the silicone resin was not used. Carrier L had an electric resistivity in terms of log R of 13.6 Ω·cm at 50 V/mm and of 12.4 Ω·cm at 250 V/mm. The yield of Carrier L was 62%.

Preparation Example IV-13

Carrier M was prepared by the procedure of Preparation Example IV-1, except that the carrier particles were not heated at 210° C. Carrier M had an electric resistivity in terms of log R of 9.8 Ω·cm at 50 V/mm and of 8.5 Ω·cm at 250 V/mm. The yield of Carrier M was 87%.

Preparation Example IV-14

Carrier N was prepared by the procedure of Preparation Example IV-1, except that a coating liquid prepared in the following manner was used as the coating liquid. Specifically, 10 parts of a methoxymethylated polyamide EF 30T (trade name, available from Nagase Chemtex Corporation) and 2 parts in terms of solid contents of a resol type phenolic resin PR 51283 (trade name, available from Sumitomo Bakelite Co., Ltd.) were dissolved in 80 parts of methanol. The solution was treated with acetic acid to be pH 4, followed by heating under reflux at 50° C. for 3 hours. A total of 1 part of 3-(2-aminoethylaminopropyl) trimethoxysilane, 5 parts carbon black (BP 2000) and 5 parts of hydrophobic silica particles R 972 (trade name, available from Nippon Aerosil Co., Ltd.) were added to solid contents of the solution, the mixture was diluted with 80 parts of methanol and 80 parts of acetone. The diluted mixture was stirred and dispersed in a homogenizer and thereby yielded the coating liquid. Carrier N had an electric resistivity in terms of log R of 13.7 Ω·cm at 50 V/mm and of 12.9 Ω·cm at 250 V/mm. The yield of Carrier N was 82%.

Example IV-1

A developer was prepared by mixing 93 parts of Carrier A prepared in Preparation Example IV-1 and 7 parts of a black toner for IPSIO Color 8000 (trade name, available from Ricoh Company, Ltd.). The developer was charged to IPSIO Color 8000, and, as a printing test, a character image chart with an image area ratio of 12% was continuously printed out on 100,000 sheets using the machine.

[Evaluation]

Properties of the developer were determined in the following manner.

(1) Charge Amount and Toner Deposition on the Background Images

A small amount of the developer was sampled at the beginning of the 100,000-sheets printing test, and the charge amount of the carrier in the developer was determined. The toner deposition on the background of images and the charge amount of the developer after the completion of the 100,000-sheets printing test were also determined. The charge amounts of the carrier under conditions of 40° C. and 90% relative humidity (RH) and after storage for 1 week were determined.

The charge amount of the developer was determined according to a conventional blow off procedure using a small amount of the developer sampled from a sleeve of the development device or sampled from the developer under the aforementioned conditions.

The toner deposition on the background of images was evaluated in four levels by visual observation according to the following criteria.

(2) Wear Rate of Coating Layer

The thickness of the coating layer of the carrier particles was determined at the beginning of (initial) and after the 100,000-sheets printing test by pulverizing the carrier particles and observing the section of the pulverized particle using a scanning electron microscope (SEM). The wear rate of the coating layer was determined according to the following equation:

$$\text{Wear rate } (\%) = 100 \times [(T1 - T2)/T1]$$

wherein T1 is the initial thickness of the coating layer before the printing test; and T2 is the thickness of the coating layer after the printing test.

The uniformity of the coating layer of the carrier was evaluated in four levels by visual observation on a SEM photograph.

(3) Spent Amount

The spent amount was determined in the following manner.

The carrier (1 g) was separated from the developer, was dissolved in 10 g of a 1:1 mixture of methyl ethyl ketone (MEK) and toluene. The absorbance at 320 nm to 700 nm of supernatant of the solution was determined with a spectrophotometer. The average of the absorbances at individual wavelengths was defined as the spent amount, wherein the average absorbance of the 1:1 mixture of methyl ethyl ketone (MEK) and toluene was set at 100%.

The results are shown in Table 5. The symbols in Table 5 have the following meanings.

AA: Excellent

BB: Good

CC: Fair

DD: Failure (not acceptable)

Examples IV-2 through IV-11 and Comparative Examples IV-1 through IV-3

Developers were prepared and properties thereof were determined by the procedure of Example IV-1, except that each of Carriers B through N was used instead of Carrier A as shown in Table 5. The results are shown in Table 5.

TABLE 5-1

| | Carrier | Carrier (%) | Initial charge amount of developer [−μc/g] | Initial toner deposition on background | Charge amount of developer after printing [−μc/g] |
|---|---|---|---|---|---|
| Example IV-1 | Carrier A | 86 | 35.4 | AA | 25.7 |
| Example IV-2 | Carrier B | 84 | 33.7 | AA | 27.6 |
| Example IV-3 | Carrier C | 77 | 31.5 | AA | 25.4 |
| Example IV-4 | Carrier D | 85 | 33.2 | AA | 26.2 |
| Example IV-5 | Carrier E | 86 | 25.8 | BB | 21.9 |
| Example IV-6 | Carrier F | 84 | 36.8 | AA | 28.9 |
| Example IV-7 | Carrier G | 84 | 39.6 | AA | 35.9 |
| Example IV-8 | Carrier H | 88 | 38.2 | AA | 34.9 |
| Example IV-9 | Carrier I | 84 | 34.8 | BB | 34.4 |
| Example IV-10 | Carrier J | 87 | 37.6 | BB | 40.1 |
| Example IV-11 | Carrier K | 88 | 36.2 | AA | 37.3 |
| Comp. Ex. III-1 | Carrier L | 62 | 30.6 | BB | 17 |
| Comp. Ex. III-2 | Carrier M | 87 | 31.4 | CC | 12.1 |
| Comp. Ex. III-3 | Carrier N | 82 | 21.9 | BB | 15.4 |

TABLE 5-2

| | Toner deposition on background after printing | Charge amount at 40° C. and 90% R.H. [−μc/g] | Wear rate of coating layer (%) | Change amount of developer after 1 week [−μc/g] | Spent amount (%) |
|---|---|---|---|---|---|
| Example IV-1 | AA | 23.2 | 20 | 21.7 | 82.6 |
| Example IV-2 | AA | 23.3 | 18 | 21.1 | 82.8 |
| Example IV-3 | AA | 21.2 | 17 | 19.6 | 82.6 |
| Example IV-4 | AA | 18.4 | 12.5 | 21.9 | 79.4 |
| Example IV-5 | AA | 21 | 13.5 | 19.7 | 84.2 |
| Example IV-6 | AA | 26.1 | 15 | 22.1 | 83.4 |
| Example IV-7 | AA | 29.8 | 7 | 28 | 85.7 |
| Example IV-8 | AA | 27.2 | 9 | 22.2 | 84.5 |
| Example IV-9 | AA | 32.1 | 8 | 27.7 | 83.3 |
| Example IV-10 | AA | 32.4 | 2 | 31.8 | 82.1 |
| Example IV-11 | AA | 31.4 | 1 | 30.3 | 87.6 |
| Comp. Ex. III-1 | DD | 5.2 | 65 | 3.9 | 64 |
| Comp. Ex. III-2 | DD | 3.9 | 70 | 1.8 | 48.2 |
| Comp. Ex. III-3 | DD | 12.5 | 9 | 12.5 | 71.4 |

As is described in detail above, the carriers of the present invention each have a coating layer comprising a condensation product of an alkoxyalkylated polyamide and a silicone resin that is reactive with the polyamide and thereby having excellent charging ability and wear resistance. By using a silicone resin having a silanol group and/or a hydrolyzable group as the silicone resin, further using an aminosilane coupling agent and allowing a catalyst to react in a secondary heating process after coating the coating liquid, the resulting carriers can have charges with higher durability and less variation depending on use environment and can thereby have excellent reliability and improved productivity.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A carrier for developing latent electrostatic images, comprising:

a magnetic particle; and a coating layer covering the magnetic particle, wherein the coating layer comprises a condensation product of a composition comprising:

(i) an alkoxyalkylated polyamide, and (ii) a silicone resin that is reactive with the alkoxyalkylated polyamide.

2. A carrier according to claim 1, wherein the coating layer has a wear rate of 50% or less as determined after reproducing 100,000 copies of a character image with an image areal ratio of 12% using a developer comprising 93 parts by weight of the carrier and 7 parts by weight of a toner with a copying machine.

3. A carrier according to claim 1, wherein the composition further comprises (iii) a silicone compound having at least one group selected from group consisting of a hydrolyzable group, a group capable of crosslinking upon polycondensation and a mixture thereof.

4. A carrier according to claim 3, wherein the silicone compound (iii) is at least one compound selected from the group consisting of an aminosilane coupling agent, a monofunctional silane compound, a bifunctional silane compound and mixtures thereof, wherein said monofunctional silane compound has at least one of a terminal group selected from the group consisting of a) a group represented by formula: $C_nH_{2n+1}$—, wherein n is an integer of 1 to 4, b) a phenyl group and c) mixtures thereof, wherein said bifunctional silane compound has at least one of a terminal group selected from the group consisting of a) a group represented by formula: $C_nH_{2n+1}$—, wherein n is an integer of 1 to 4, b) a phenyl group and c) mixtures thereof.

5. A carrier according to claim 4, wherein the monofunctional or bifunctional silane compound has at least one group selected from the group consisting of a hydroxyl group, a methoxy group, an ethoxy group and combinations thereof.

6. A carrier according to claim 4, wherein the aminosilane coupling agent has an amino equivalent of 170 to 230.

7. A carrier according to claim 1, wherein the alkoxyalkylated polyamide is at least one N-alkoxyalkylated polyamide having a repeating unit represented by following Formula I:

Formula I

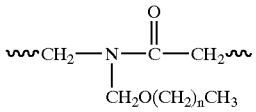

wherein "n" is an integer of 0 to 5.

8. A carrier according to claim 7, wherein "n" in Formula I is an integer of 1 to 5.

9. A carrier according to claim 8, wherein the N-alkoxyalkylated polyamide is an N-butoxymethylated polyamide.

10. A carrier according to claim 1, wherein the alkoxyalkylated polyamide is an N-alkoxyalkylated polyamide having an alkoxylation ratio of 20% by mole to 70% by mole.

11. A carrier according to claim 1, wherein the silicone resin is a resin containing a silicone at least having a silanol group and/or a hydrolyzable group.

12. A carrier according to claim 1, wherein the condensation product is a product of a condensation reaction between the alkoxyalkylated polyamide and the silicone resin, and a self-condensation reaction of the silicone resin.

13. A carrier according to claim 1, wherein the carrier contains a positively chargeable site that is positively chargeable when the carrier is mixed with a toner.

14. A carrier according to claim 13, wherein the positively chargeable site is an amide bonding site in the condensation product.

15. A carrier according to claim 1, wherein the composition further comprises an organic solid acid having a boiling point of 100° C. or higher as a catalyst.

16. A carrier according to claim 1, wherein the composition further comprises a methylol melamine.

17. A carrier according to claim 1, wherein the composition further comprises a methylol benzoguanamine.

18. A carrier according to claim 1, wherein the composition further comprises a phenol resin.

19. A carrier according to claim 1, wherein the carrier has an electric resistivity in terms of log R of 14 or more at an applied electric field of 50 V/mm and an electric resistivity in terms of log R of 16 or less at an applied electric field of 250 V/mm.

20. A carrier according to claim 1, wherein the coating layer further comprises a low-resistance substance having an electric resistivity of $10^{-4}$ to $10^{8}$ Ω·cm.

21. A carrier according to claim 20, wherein the low-resistance substance is electrically conductive carbon.

22. A carrier according to claim 1, wherein the coating layer comprises hard fine particles.

23. A carrier according to claim 22, wherein the hard fine particles are metal oxide particles or inorganic oxide particle, and wherein the hard fine particles comprise at least one member selected from the group consisting of silicon oxide, titanium oxide, aluminum oxide and mixture thereof.

24. A carrier according to claim 23, wherein the content of the hard fine particles in the coating layer is from 5% by weight to 70% by weight of the coating layer.

25. A carrier according to claim 1, wherein the carrier has a weight-average particle diameter Dw in a range of 25 μm to 45 μm, wherein the carrier comprises component particles having a diameter of less than 44 μm in an amount of 70% by weight or more, and component particles having a diameter of less than 22 μm in an amount of 7% by weight or less, based on the total amount of the carrier, and wherein the ratio Dw/Dp of the weight-average particle diameter Dw of the carrier to a number-average particle diameter Dp of the carrier is in a range of 1.00 to 1.30.

26. A developer for latent electrostatic images, comprising:

a toner; and a carrier, the carrier which comprises:

a magnetic particle; and a coating layer covering the magnetic particle, wherein the coating layer comprises a condensation product of a composition comprising an alkoxyalkylated polyamide and a silicone resin that is reactive with the alkoxyalkylated polyamide.

27. A process cartridge comprising:

a development unit configured to develop a latent electrostatic image formed on a surface of a latent electrostatic image bearing member; and at least one member selected from the group consisting of a latent electrostatic image bearing member, a charging unit configured to uniformly charge the latent electrostatic image bearing member, and a blade configured to wipe off a developer remained on a surface of the latent electrostatic image bearing member, the process cartridge being integrated with and detachable with an image forming apparatus, wherein the development unit houses:

a toner; and a carrier, the carrier which comprises:

a magnetic particle; and a coating layer covering the magnetic particle, wherein the coating layer comprises a condensation product of a composition comprising an alkoxyalkylated polyamide and a silicone resin that is reactive with the alkoxyalkylated polyamide.

28. An image forming apparatus comprising:

a latent electrostatic image bearing member;

a charging unit configured to uniformly charge the latent electrostatic image bearing member;

an exposing unit configured to applying the latent electrostatic image bearing member with light imagewise to form a latent image;

a development unit containing a developer, configured to develop the latent image using the developer to form a toner image; and a transferring unit configured to transfer the toner image from the latent electrostatic image bearing member to a recording medium, wherein the developer comprises:

a toner; and a carrier, the carrier which comprises:

a magnetic particle; and a coating layer covering the magnetic particle, wherein the coating layer comprises a condensation product of a composition comprising an alkoxyalkylated polyamide and a silicone resin that is reactive with the alkoxyalkylated polyamide.

29. An image forming process comprising the steps of:

charging a latent electrostatic image bearing member;

exposing the charged latent electrostatic image bearing member to light imagewise to form a latent electrostatic image;

developing the latent electrostatic image by supplying a developer thereto to thereby form a visible toner image; and transferring the formed toner image to a transfer member, wherein the developer comprises:

a toner for developing latent electrostatic images; and a carrier for developing latent electrostatic images, the carrier which comprises:

a magnetic particle; and a coating layer covering the magnetic particle, wherein the coating layer comprises a condensation product of a composition comprising an alkoxyalkylated polyamide and a silicone resin that is reactive with the alkoxyalkylated polyamide.

* * * * *